US011957285B2

(12) United States Patent
Li et al.

(10) Patent No.: US 11,957,285 B2
(45) Date of Patent: Apr. 16, 2024

(54) AUTOMATIC CLEANING DEVICE

(71) Applicant: BEIJING ROBOROCK TECHNOLOGY CO., LTD., Beijing (CN)

(72) Inventors: Xing Li, Beijing (CN); Pan Cheng, Beijing (CN); Chuanlin Duan, Beijing (CN); Zhimin Yang, Beijing (CN); Song Peng, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/864,417

(22) Filed: Jul. 14, 2022

(65) Prior Publication Data

US 2022/0338698 A1 Oct. 27, 2022

Related U.S. Application Data

(63) Continuation of application No. PCT/CN2021/074946, filed on Feb. 2, 2021.

(30) Foreign Application Priority Data

Sep. 25, 2020 (CN) ..... 202011024890.1
Sep. 25, 2020 (CN) ..... 202011024897.3
(Continued)

(51) Int. Cl.
*A47L 11/292* (2006.01)
*A47L 11/29* (2006.01)
*A47L 11/40* (2006.01)

(52) U.S. Cl.
CPC ..... *A47L 11/292* (2013.01); *A47L 11/29* (2013.01); *A47L 11/4016* (2013.01);
(Continued)

(58) Field of Classification Search
CPC ..... A47L 11/292; A47L 11/4016; A47L 11/4063; A47L 11/408; A47L 11/4052;
(Continued)

(56) References Cited

U.S. PATENT DOCUMENTS 11,426,048 B2 * 8/2022 Fang ..... A47L 11/4002
2014/0182627 A1 7/2014 Williams
(Continued)

FOREIGN PATENT DOCUMENTS

BR 102017011136 A2 12/2017
CN 1889881 A 1/2007
(Continued)

OTHER PUBLICATIONS

Machine translation of CN-211519074-U (Year: 2022).*
(Continued)

*Primary Examiner* — Steven M Cernoch
*Assistant Examiner* — Sarah Akyaa Fordjour
(74) *Attorney, Agent, or Firm* — Andrew C. Cheng

(57) ABSTRACT

An automatic cleaning device includes a mobile platform, a lifting station, a cleaning module, a liquid supplying module, and a collecting module. The mobile platform is configured to automatically move in a target direction on a surface to be cleaned. The lifting station is connected to the mobile platform and configured to move upwards or downwards with respect to the mobile platform. The cleaning module is connected to the lifting station and configured to clean the surface to be cleaned; the liquid supplying module is configured to provide cleaning liquid to the surface to be cleaned; and the collecting module is configured to collect the cleaning liquid. A height of the cleaning module of the automatic cleaning device is adjustable, and the automatic cleaning device has a great cleaning strength and is capable
(Continued)

of collecting dirty cleaning liquid, thus, the automatic cleaning device can be applied broadly.

19 Claims, 9 Drawing Sheets

(30) Foreign Application Priority Data

Sep. 25, 2020 (CN) ..... 202011027130.6
Sep. 25, 2020 (CN) ..... 202011027138.2

(52) U.S. Cl.
CPC ..... *A47L 11/4036* (2013.01); *A47L 11/4063* (2013.01); *A47L 11/4066* (2013.01); *A47L 11/4069* (2013.01); *A47L 11/408* (2013.01); *A47L 11/4083* (2013.01); *A47L 11/4088* (2013.01); *A47L 2201/00* (2013.01); *A47L 2201/04* (2013.01)

(58) Field of Classification Search
CPC ..... A47L 11/4055; A47L 11/4058; A47L 2201/00; A47L 11/4013; A47L 11/29
See application file for complete search history.

(56) References Cited

U.S. PATENT DOCUMENTS

| | | | | |
|---|---|---|---|---|
| 2019/0290089 | A1 | 9/2019 | Johnson et al. | |
| 2020/0297179 | A1* | 9/2020 | Fang | A47L 11/4088 |
| 2022/0000327 | A1* | 1/2022 | Zhang | A47L 11/24 |
| 2022/0079406 | A1* | 3/2022 | Zhang | A47L 11/4061 |

FOREIGN PATENT DOCUMENTS

| | | | | |
|---|---|---|---|---|
| CN | 201861568 | U | | 6/2011 |
| CN | 202960388 | U | | 6/2013 |
| CN | 104244795 | A | | 12/2014 |
| CN | 104720692 | A | | 6/2015 |
| CN | 105342528 | A | | 2/2016 |
| CN | 205411093 | U | | 8/2016 |
| CN | 106166050 | A | | 11/2016 |
| CN | 107510417 | A | | 12/2017 |
| CN | 206700117 | U | | 12/2017 |
| CN | 108042053 | A | | 5/2018 |
| CN | 108888196 | A | | 11/2018 |
| CN | 109199205 | A | * | 1/2019 |
| CN | 109199205 | A | | 1/2019 |
| CN | 109602340 | A | | 4/2019 |
| CN | 209018628 | U | | 6/2019 |
| CN | 110279353 | A | | 9/2019 |
| CN | 209360574 | U | | 9/2019 |
| CN | 110558900 | A | | 12/2019 |
| CN | 111375575 | A | * | 7/2020 |
| CN | 211212938 | U | | 8/2020 |
| CN | 211519074 | U | * | 9/2020 |
| JP | H04354 | U | | 1/1992 |
| JP | H041222 | U | | 1/1992 |
| JP | 2003265384 | A | | 9/2003 |
| JP | 2005025083 | A | | 1/2005 |
| JP | 2007513659 | A | | 5/2007 |
| JP | 3220612 | U | | 3/2019 |
| KR | 1020120088314 | A | | 8/2012 |
| WO | 2006089307 | A2 | | 8/2006 |

OTHER PUBLICATIONS

Translation of CN-111375575-A (Year: 2023).*
Translation of CN_109199205_A (Year: 2023).*
International Search Report of PCT Patent Application No. PCT/CN2021/074946 issued on Jul. 7, 2021.
The first search report of CN application No. 202011024890.1 issued on Nov. 1, 2022.
The first search report of CN application No. 202011024897.3 issued on Nov. 14, 2022.
The second search report of CN application No. 202011024897.3 issued on Apr. 11, 2023.
The first search report of CN application No. 202011027130.6 issued on Dec. 5, 2022.
The first search report of CN application No. 202011027138.2 issued on Dec. 5, 2022.
The Office Action of IN application No. 202227033159 issued on May 31, 2023.
The extended European Search Report of EP application No. 21870686.9 issued on Aug. 14, 2023.
The Office Action of CA application No. 3161243 issued on Aug. 21, 2023.
The Examination report of AU application No. 2021349067 issued on Aug. 26, 2023.
The Office Action of JP patent application No. 2022-550851 issued on Oct. 3, 2023.
The Office Action of EA patent application No. 202392699 issued on Feb. 22, 2024.

* cited by examiner

AUTOMATIC CLEANING DEVICE

CROSS REFERENCE TO RELATED APPLICATIONS

This application is a continuation application of International Patent Application No. PCT/CN2021/074946, filed on Feb. 2, 2021, which claims priority of China Patent Application Nos. CN 202011027138.2 filed on Sep. 25, 2020, CN202011027130.6 filed on Sep. 25, 2020, CN202011024890.1 filed on Sep. 25, 2020, and CN202011024897.3 filed on Sep. 25, 2020, the contents of which are incorporated herein by reference in its entirety.

TECHNICAL FIELD

The present disclosure relates to an automatic device, in particular to an automatic cleaning device.

BACKGROUND

With the acceleration of the pace of contemporary life and the increase in labor costs, more and more homes and businesses use automatic cleaning devices to clean the floor, glass surfaces, and the like. While the emergence of automatic cleaning devices greatly reduces the time and cost for cleaning by human, there are still many problems with the automatic cleaning devices. For example, automatic cleaning devices can only be used to clean flat surfaces; heights of cleaning modules of automatic cleaning devices cannot be adjusted to keep the cleaning modules in tight contact with a surface to be cleaned, which makes it difficult for the automatic cleaning devices to move freely on the surface to be cleaned or resistance to the movement of the automatic cleaning devices very great when the cleaning device is not doing cleaning; and cleaning cannot be completed thoroughly and dirty water is remained on the cleaned surface, and etc.

Therefore, it is desirable to provide an automatic cleaning device, a height of a cleaning module of which is adjustable, which has a high cleaning efficiency and is capable to collect dirty water, and which can be applied in various cleaning environments.

SUMMARY

The present disclosure provides an automatic cleaning device, which has various cleaning functions and is applicable to various surfaces to be cleaned. Moreover, the automatic cleaning device has a high cleaning efficiency and is capable to collect dirty water, and the automatic cleaning device can adjust a height of its components as well.

According to an aspect of the present disclosure, an automatic cleaning device is provided. The automatic cleaning device includes a mobile platform, a cleaning module, and a driving unit. The mobile platform is configured to automatically move in a target direction on a surface to be cleaned. The cleaning module is mounted on the mobile platform and includes a cleaning-head configured to clean the surface to be cleaned. The driving unit is connected to the cleaning-head, and configured to drive the cleaning-head to make a reciprocating movement on a target surface.

In some embodiments of the present disclosure, the reciprocating movement includes a motion component perpendicular to the target direction.

In some embodiments of the present disclosure, the reciprocating movement includes a motion component parallel to the target direction.

In some embodiments of the present disclosure, the reciprocating movement includes a preset reciprocating cycle.

In some embodiments of the present disclosure, the preset reciprocating cycle is adjustable automatically and dynamically by the automatic cleaning device in accordance with the operation environment of the automatic cleaning device.

In some embodiments of the present disclosure, the cleaning-head has a plate-like structure and includes a working-head, wherein the working-head includes at least one of a brush, a rag, and a sponge.

In some embodiments of the present disclosure, the automatic cleaning device further includes a nozzle configured to provide a target liquid onto the surface to be cleaned.

In some embodiments of the present disclosure, the mobile platform includes a protrusion; and the cleaning-head includes a sliding end, the sliding end including a groove, wherein the sliding end is slidably sleeved over the protrusion through the groove.

In some embodiments of the present disclosure, the cleaning-head includes a sliding end which includes a slider, wherein the reciprocating movement includes the slider conducting a reciprocating movement in a direction perpendicular to the target direction.

In some embodiments of the present disclosure, the driving unit includes an engine and at least one driving wheel connected to the engine.

In some embodiments of the present disclosure, the cleaning-head includes a swing end connected to the driving unit, wherein the driving unit drives the swing end to conduct a circular swing motion.

In some embodiments of the present disclosure, the swing end is connected to a position of a driving wheel of the at least one driving wheel at a preset distance from a swing center of the driving wheel.

In some embodiments of the present disclosure, a distance between the cleaning-head and a bottom surface of the mobile platform is adjustable.

In some embodiments of the present disclosure, the cleaning-head has a plate-like structure, and the cleaning module further includes an elastic support structure at a back of the cleaning-head to support the cleaning-head elastically.

In some embodiments of the present disclosure, the cleaning module further includes a lifting station mounted on the mobile platform, wherein a distance between the lifting station and the bottom surface of the mobile platform is adjustable, and wherein the cleaning-head is mounted on the lifting station.

According to another aspect of the present disclosure, a method of automatically cleaning a surface to be cleaned includes: driving a mobile platform to automatically cruise in a target direction on a surface to be cleaned; and driving a cleaning-head to conduct reciprocating movement on the surface to be cleaned, wherein the cleaning-head is mounted on the mobile platform.

In some embodiments of the present disclosure, the reciprocating movement includes a motion component perpendicular to a cruising path.

In some embodiments of the present disclosure, the reciprocating movement includes a motion component parallel to a cruising path.

In some embodiments of the present disclosure, the reciprocating movement includes a swing movement.

In some embodiments of the present disclosure, driving the cleaning-head to conduct the reciprocating movement on the surface to be cleaned includes driving the cleaning-head through a slider-crank mechanism to conduct the reciprocating movement.

In some embodiments of the present disclosure, driving the cleaning-head to conduct the reciprocating movement on the surface to be cleaned includes driving the cleaning-head through a double crank mechanism to conduct the reciprocating movement.

In some embodiments of the present disclosure, the method further includes dynamically adjusting a position of the cleaning-head according to a contour of the surface to be cleaned to keep the cleaning-head in tight contact with the surface to be cleaned.

In some embodiments of the present disclosure, the method further includes supplying target liquid to the surface to be cleaned.

According to an aspect of the present disclosure, an automatic cleaning device includes: a mobile platform, a lifting station, and a cleaning module, wherein the mobile platform is configured to automatically move in a target direction on a surface to be cleaned, the lifting station is connected to the mobile platform and configured to move upwards or downwards with respect to the mobile platform, and the cleaning module is mounted on the mobile platform and configured to clean the surface to be cleaned.

In some embodiments of the present disclosure, the lifting station includes: a lifting mechanism and a base, wherein the lifting mechanism is connected to the mobile platform and configured to drive the lifting station to move upwards or downwards with respect to the mobile platform, the base is connected to the lifting mechanism and configured to move upwards or downwards with respect to the mobile platform as driven by the lifting mechanism, and the base includes a first connection end adjacent to a front end of the mobile platform and a second connection end adjacent to a rear end of the mobile platform.

In some embodiments of the present disclosure, the base further includes an auxiliary wheel, wherein the auxiliary wheel first touches the surface to be cleaned when the base moves downwards with respect to the mobile platform.

In some embodiments of the present disclosure, the lifting mechanism is a flexible pulling mechanism which suspends the base on the mobile platform, and the flexible pulling mechanism is configured to draw the base upwards or downwards with respect to the mobile platform via the first cable.

In some embodiments of the present disclosure, the automatic cleaning device further includes a connection rod which includes a first hinge end hinged to a first connection end of the base and a second hinge end hinged to the mobile platform.

In some embodiments of the present disclosure, the flexible pulling mechanism includes a suspension mechanism and a driving mechanism, wherein the suspension mechanism includes a first cable through which the base is suspended on the mobile platform, and the driving mechanism is configured to drive the base to move upwards or downwards with respect to the mobile platform.

In some embodiments of the present disclosure, the suspension mechanism includes at least one cable guide mounted on the base to allow the first cable to pass through, wherein an extending direction of the first cable changes when passing through the at least one cable guide.

In some embodiments of the present disclosure, the at least one cable guide includes: at least one of at least one pulley, at least one guide turning, and at least one guide protrusion.

In some embodiments of the present disclosure, the base includes a first side and a second side, the at least one cable guide includes a first guide turning, a second guide turning, and a fixed pulley, the first cable guide turning is disposed on the first side to guide the first cable entering the first guide turning from an upper portion of the base to the second side, the second guide turning is disposed on the second side to guide the first cable to a direction toward the upper portion of the base, and the fixed pulley is configured to guide the first cable to a direction toward a lower portion of the base, and the first cable sequentially passes through the first guide turning, the second guide turning and the fixed pulley from the upper portion of the base.

In some embodiments of the present disclosure, the first cable includes a first end connected to the mobile platform and a second end connected to the driving mechanism.

In some embodiments of the present disclosure, the driving mechanism includes a power device and a driving wheel connected to the power device.

In some embodiments of the present disclosure, the driving mechanism further includes a driving coupler connected to the mobile platform and coupled to the driving wheel, wherein the driving wheel moves linearly with respect to the driving coupler when the driving wheel rotates.

In some embodiments of the present disclosure, the driving wheel includes a gear and the driving coupler includes a rack meshed with the gear.

In some embodiments of the present disclosure, the driving coupler includes a connection cable, and the driving coupler is hanged to the mobile platform through the connection cable.

In some embodiments of the present disclosure, the rack includes a sliding end connected to the connection cable and the base includes a sliding slot, wherein the sliding end moves in a direction of the sliding slot.

In some embodiments of the present disclosure, the rack includes a connection end connected to the mobile platform.

In some embodiments of the present disclosure, the driving coupler includes a second cable, a first end of the second cable is fixed to the mobile platform, and a second end of the second cable is wound around the driving wheel.

In some embodiments of the present disclosure, the second end of the first cable is connected to the driving coupler.

In some embodiments of the present disclosure, the second end of the first cable is wound around the driving wheel.

In some embodiments of the present disclosure, the driving wheel is mounted on the base or on the mobile platform.

According to an aspect of the present disclosure, the automatic cleaning device includes: a mobile platform, a cleaning module, a liquid supply module, and a collecting module, wherein the mobile platform is configured to automatically move in a target direction on a surface to be cleaned, the cleaning module is connected to the mobile platform and configured to clean the surface to be cleaned, the liquid supplying module is connected to the mobile platform and configured to supply a cleaning liquid to the surface to be cleaned, and the collecting module is connected to the mobile platform and configured to collect the cleaning liquid.

In some embodiments of the present disclosure, the collecting module is disposed behind the liquid supplying module.

In some embodiments of the present disclosure, the cleaning module is disposed between the liquid supplying module and the collecting module, and is configured to clean the surface to be cleaned with the cleaning liquid.

In some embodiments of the present disclosure, the automatic cleaning device further includes a lifting station, and the lifting station is mounted on the mobile platform and configured to move upwards or downwards with respect to the mobile platform.

In some embodiments of the present disclosure, the liquid supplying module is mounted at least partially on the lifting station.

In some embodiments of the present disclosure, the collecting module is mounted at least partially on the lifting station.

In some embodiments of the present disclosure, the liquid supplying module includes a storage device mounted on the mobile platform to store the cleaning liquid, the storage device is provided with an opening, and the cleaning liquid is applied to the surface to be cleaned through the opening.

In some embodiments of the present disclosure, the liquid supplying module further includes a dispenser, the dispenser is connected to the opening of the storage device, wherein the cleaning liquid flows to the dispenser through the opening, and is evenly distributed to the surface to be cleaned through the dispenser.

In some embodiments of the present disclosure, the liquid supplying module further includes a liquid supply driving device mounted at the opening of the storage device and connected to the dispenser, wherein the liquid supply driving device is configured to draw the cleaning liquid from the storage device to the dispenser.

In some embodiments of the present disclosure, the collecting module includes a roller which is pivotally connected to the mobile platform and rotates with respect to the mobile platform, when the collecting module is in operation, the roller is kept in contact with the surface to be cleaned, wherein the roller includes an elastic water-absorbing material to absorb the cleaning liquid on the surface to be cleaned.

In some embodiments of the present disclosure, the collecting module further includes a roller driving device connected to the roller and configured to drive the roller to rotate.

In some embodiments of the present disclosure, the collecting module further includes a collecting assembly connected to the mobile platform and configured to collect the cleaning liquid absorbed by the roller, and the collecting assembly includes: a scraper configured to press the roller to squeeze out the cleaning liquid absorbed by the roller, wherein the roller passes by the scraper in a top to bottom direction when the roller rotates.

In some embodiments of the present disclosure, the roller driving device is configured to drive the roller to move in a direction opposite to the target direction, so that a linear velocity of a portion of the roller in contact with the surface to be cleaned is pointed to a front side of the mobile platform, wherein the scraper is disposed behind the roller.

In some embodiments of the present disclosure, the collecting assembly further includes a sink connected to the scraper and configured to receive the cleaning liquid squeezed out from the roller by the scraper.

In some embodiments of the present disclosure, the collecting assembly further includes a collecting bin, wherein the sink includes a collecting port, and the collecting bin is communicated with the sink through the collecting port.

In some embodiments of the present disclosure, the collecting assembly further includes a blade pivotally disposed in the sink and the blade is configured to rotate within the sink so as to transport the cleaning liquid from the sink to the collecting port.

In some embodiments of the present disclosure, the collecting assembly further includes a collecting assembly driving device configured to draw the cleaning liquid at the collecting port to the collecting bin.

In some embodiments of the present disclosure, the collecting assembly further includes a blade driving device connected to the blade and configured to drive the blade to rotate.

In some embodiments of the present disclosure, the blade includes a screw conveyor.

In some embodiments of the present disclosure, the collecting assembly further includes a filter disposed at the collecting port and configured to filter impurities in the cleaning liquid.

According to some embodiments, the automatic cleaning device further includes a vacuum module connected to the mobile platform and configured to vacuum debris on the surface to be cleaned into the vacuum module.

According to another aspect of the present disclosure, a method of automatically cleaning a surface to be cleaned includes: driving a mobile platform to automatically cruise in a target direction on a surface to be cleaned; driving a vacuum module to vacuum litters on the surface to be cleaned; driving a liquid supplying module to apply a cleaning liquid onto the surface to be cleaned; driving a cleaning module to clean the surface to be cleaned; and driving a collecting module to collect the cleaning liquid from the surface to be cleaned, wherein the vacuum module, the liquid supplying module, the cleaning module, and the collecting module are mounted on the mobile platform.

In some embodiments of the present disclosure, the method of automatically cleaning the surface to be cleaned further includes: when cleaning is started, driving a lifting station to move downwards to contact the surface to be cleaned; and when the cleaning finishes, driving the lifting station to move upwards away from the surface to be cleaned.

In some embodiments of the present disclosure, the cleaning module is mounted on the mobile platform through a lifting station.

In some embodiments of the present disclosure, the vacuum module is mounted on the mobile platform through a lifting station.

In some embodiments of the present disclosure, the automatic cleaning device according to the embodiments of the present disclosure has a great cleaning strength. Moreover, adjustment of heights of the cleaning module or the vacuum module is achieved. Additionally, the automatic cleaning device according to the present disclosure supplies cleaning liquid onto the surface to be cleaned through the liquid supplying module, and the cleaning module cleans the surface to be cleaned with the cleaning liquid, thus the surface to be cleaned can be cleaned effectively and the cleaning module has a great cleaning strength. Furthermore, the automatic cleaning device according to the embodiments of the present disclosure can collect dirty cleaning liquid on the surface to be cleaned so as to ensure no residual of dirty cleaning liquid on the surface to be cleaned. A method of automatically cleaning a surface to be cleaned is further provided in the present disclosure. The cleaning module and/or the vacuum module are movable upwards or downwards along with the lifting station, the lifting station is driven to move downwards during cleaning and the lifting station is driven to move upwards after the cleaning finishes.

Other features of the present disclosure will be described in the following description. According to the description, the following numbers and examples will be obvious to one of ordinary skill in the art. The creative concept of this disclosure can be thoroughly explained by practicing or by implementing the methods, the devices, and combinations thereof described in the detailed examples below.

DETAILED DESCRIPTION OF THE EMBODIMENTS

The following description provides detailed application scenarios and requirements of the present disclosure in order to enable one of ordinary skill in the art to make and use the present disclosure. Various modifications to the disclosed embodiments will be apparent to one of ordinary skill in the art. The general principles defined herein is applicable to other embodiments and applications without departing from the spirit and the scope of the disclosure. Therefore, the protection scope of the present disclosure is not limited to the embodiments illustrated, and is defined by the broadest scope consistent with the claims.

The terminology used herein is for the purpose of describing exemplary embodiments only and is not intended to be limiting. As used herein, the singular forms "a", "an" and "the" may include their plural forms as well, unless the context clearly indicates otherwise. When used in this disclosure, the terms "comprises", "comprising", "includes", "including" and/or "have/having" refer to the presence of stated features, integers, steps, operations, elements, components and/or combinations thereof, but do not preclude the presence or addition of one or more other features, integers, steps, operations, elements, components, and/or combinations thereof. When used in this disclosure, the term "A on B" means that A is in direct contact with B (from above or below), and may also mean that A is not in contact with to B (i.e., there is an intermediate element between A and B); the term "A in B" means that A is all in B, or it may also mean that A is partially in B.

In view of the following description, these and other features disclosed herein, operations and functions of the components related to the structure, as well as the composition and cost of components, can be significantly improved. All of these form part of the present disclosure with reference to the drawings. However, it should be clearly understood that the drawings are only for the purpose of illustration and description, and are not intended to limit the protection scope of the present disclosure.

The following description may significantly improve these and other features disclosed herein, and operations and functions of components related to the structure, as well as the economic efficiency of manufacturing and assembling the components. All of these form parts of the present disclosure with reference to the drawings. However, it should also be clearly understood that the drawings are for the purpose of illustration and description only and are not intended to limit the protection scope of the present disclosure. It should also be understood that the drawings are not drawn to scale.

Figure 1:
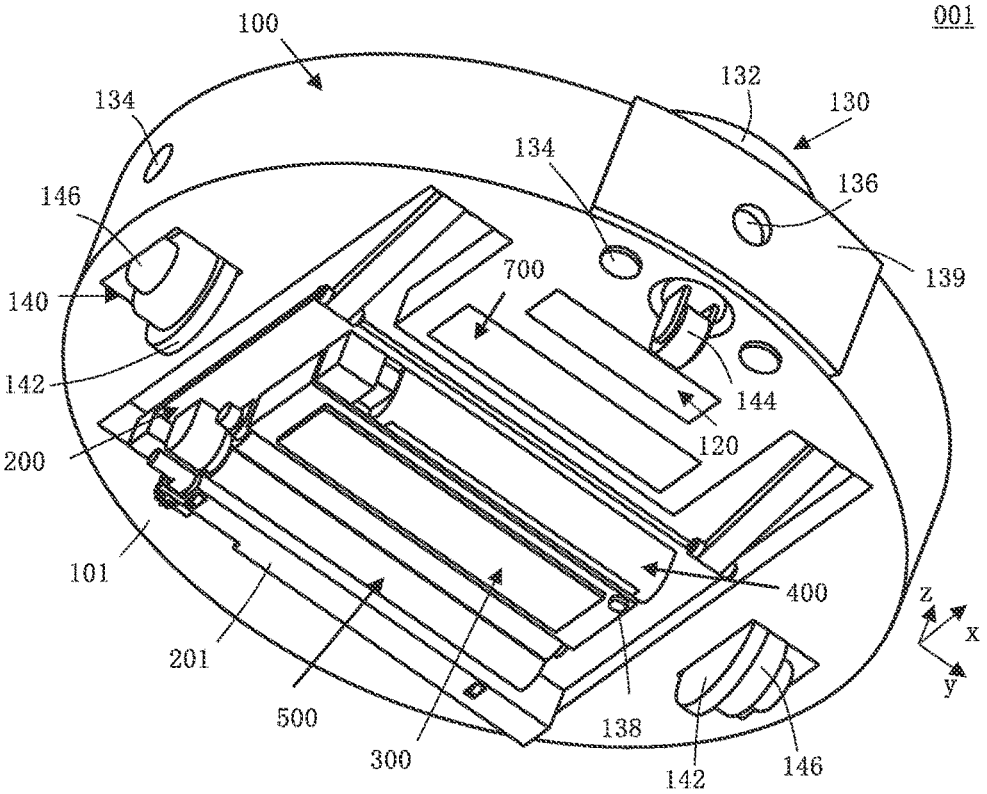
FIG. 1 is a schematic structural view of an automatic cleaning device according to an embodiment of the present disclosure.

FIG. 1 illustrates a schematic structural view of an automatic cleaning device 001 according to an embodiment of the present disclosure. The automatic cleaning device 001 may be a vacuum robot, a mopping/brushing robot, or a window-cleaning robot, and so on. In some embodiments of the present disclosure, the automatic cleaning device 001 may include a mobile platform 100, a lifting station 200, a cleaning module 300, a liquid supplying module 400 and a collecting module 500. In some embodiments, the automatic cleaning device 001 may further include a vacuum module 700. For convenience of description, it is required to define "up", "down", "left", "right", "front", and "back/rear" in the following description of the present disclosure. In the automatic cleaning device 001 according to the present disclosure, as for the coordinates as illustrated in FIG. 1, the positive direction of the x axis indicates forward, the negative direction of the x axis indicates backward/rearward, the positive direction of the y axis indicates leftward, the negative direction of the y axis indicates rightward, the positive direction of the z axis indicates upward and the negative direction of the z axis indicates downward. The lifting station 200 is disposed below the mobile platform 100, the mobile platform 100 is disposed above the lifting station 200, and the cleaning module 300 is disposed below the lifting station 200. The cleaning module 300, the liquid supplying module 400, and the collecting module 500 is disposed below the mobile platform 100, the vacuum module 700 is disposed in front of the liquid supplying module 400, and the liquid supplying module 400 is disposed in front of the collecting module 500.

The mobile platform 100 is configured to automatically move in a target direction on a surface to be cleaned, wherein the surface to be cleaned is a surface to be cleaned by the automatic cleaning device 001. In some embodiments, the automatic cleaning device 001 may be a mopping robot which operates on a floor, then the floor is the surface to be cleaned. The automatic cleaning device 001 may be a window-cleaning robot which operates on a glass outer surface of glass of a building, and then the glass outer surface is the surface to be cleaned. The automatic cleaning device 001 may further be a pipe cleaning robot which operates on an inner surface of a pipe, and then the inner surface of the pipe is the surface to be cleaned. For the purpose of illustration only, a mopping robot is taken as an example in the following description of the present disclosure.

In some embodiments, the mobile platform 100 may be an autonomous mobile platform or a non-autonomous mobile platform, wherein the autonomous mobile platform refers to a mobile platform that may autonomously and adaptively make a decision on its own to operate upon environmental inputs beyond anticipations, while the non-autonomous mobile platform refers to a mobile platform that cannot make a decision on its own adaptively for operation upon environmental inputs beyond anticipations, but can be operated according to a certain program or a logic. Accordingly, when the mobile platform 100 is an autonomous mobile platform, the target direction may be determined autonomously by the autonomous cleaning device 001; and while the mobile platform 100 is a non-autonomous mobile platform, the target direction may be set manually or by the cleaning device itself. Moreover, when the mobile platform 100 is an autonomous mobile platform, the mobile platform 100 includes a driving module 140, a sensor module 130, and a control module 120.

The driving module 140 may be mounted on the mobile platform 100. In a case that the automatic cleaning device is a vacuum robot and/or a mopping robot, the driving module 140 may include a wheel 142, a steering mechanism 144, and a power system 146. The steering mechanism 144 is arranged in front of the wheel 142. The power system 146 supplies power to the steering mechanism 144 and the wheel 142.

The sensor module 130 is mounted on the mobile platform 100 and includes one or more sensors. For example, the sensor module 130 may include a visual sensor and/or a tactile sensor. The visual sensor is configured to sense a shape of an object around the mobile platform 100. For example, the visual sensor may include a laser radar 132, an ultrasonic sensor 134, a camera 136, and the like. The tactile sensor is configured to sense certain features of shape and texture of an object around the mobile platform 100 through contact. For example, the tactile sensor may include a capacitive tentacle 138, a mechanical tentacle 139, and the like. The tactile sensor may sense presence and/or surface feature of an object through touching the object, such as determining whether the object is a floor or a carpet, or the like.

The control module 120 is configured to receive environmental information sensed by the one or more sensors and sent from the sensor module 130, autonomously determine its moving path according to the environmental information, and then control the driving module 140 to perform operations such as moving forwards, moving backwards, and/or turning according to the autonomously determined moving path. Further, the control module 120 may further determine, according to the environmental information, whether to start up the cleaning module 300 to perform a cleaning operation.

The lifting station 200 may be connected to a bottom of the mobile platform 100 and is configured to move upwards or downwards with respect to the mobile platform 100. In some embodiments of the present disclosure, moving upwards or downwards means that the lifting station 200 moves in the z axis direction with respect to the mobile platform 100. The lifting station 200 is connected to the mobile platform 100 and arranged below the mobile platform 100. The lifting station 200 may include a bottom surface 201, and the mobile platform 100 may include a bottom surface 101. When the lifting station 200 moves upwards, the bottom surface 201 of the lifting station 200 approaches the bottom surface 101 of the mobile platform 100 or is on a same plane, or substantially on a same plane, as the bottom surface 101 of the mobile platform 100, so that the bottom surface 201 of the lifting station 200 moves away from the surface to be cleaned. When the lifting station 200 moves downwards, the bottom surface 201 of the lifting station 200 moves away from the bottom surface 101 of the mobile platform 100, so that the bottom surface 201 of the lifting station 200 approaches the surface to be cleaned.

The cleaning module 300 may be mounted on the lifting station 200 and is configured to clean a surface of an object. The surface of the object herein may be the surface to be cleaned as previously described, which may be flat or non-flat, for example, floors, surfaces of desktops, glass surfaces, automotive surfaces, inner surfaces of cavities of pipes, etc. The cleaning module 300 may be connected to the mobile platform 100 directly, or may be connected to the mobile platform 100 indirectly through the lifting station 200. As illustrated in FIG. 1, the cleaning module 300 is at least partially mounted on the lifting station 200 and thus is connected to the mobile platform 100 indirectly through the lifting station 200. The cleaning module 300 moves upwards or downwards along with the lifting station 200 with respect to the mobile platform 100 to change a distance between the cleaning module 300 and the surface of the object. In a cleaning mode, the lifting station 200 moves downwards to bring the cleaning module 300 close to the surface of the object. In a non-cleaning mode, the lifting station 200 moves upwards to take the cleaning module 300 away from the surface of the object, and then, the mobile platform can move on the surface of the object.

The liquid supplying module 400 may be connected to the mobile platform 100 directly or indirectly, and may be configured to supply a cleaning liquid onto the surface to be cleaned. The liquid supplying module 400 may be connected to the mobile platform 100 directly or connected to the mobile platform 100 indirectly through the lifting station 200. As illustrated in FIG. 1, the liquid supplying module 400 may be at least partially mounted on the lifting station 200 and thus is connected to the mobile platform 100 indirectly through the lifting station 200. The liquid supplying module 400 moves upwards or downwards along with the lifting station 200 with respect to the mobile platform 100 so as to change a distance between the liquid supplying module 400 and the surface to be cleaned. In the cleaning mode, the lifting station 200 gets down to bring the liquid supplying module 400 close to the surface to be cleaned so that the liquid supplying module 400 may spray or apply the cleaning liquid onto the surface to be cleaned, thereby improving the cleaning effect of the automatic cleaning device 001. In the non-cleaning mode, the lifting station 200 rises up to make the liquid supplying module 400 move away from the surface to be cleaned, and the mobile platform 100 can move on the surface to be cleaned.

The collecting module 500 may be connected to the mobile platform 100 directly or indirectly, and is configured to collect the cleaning liquid. The collecting module 500 may be connected to the mobile platform 100 directly or connected to the mobile platform 100 indirectly through the lifting station 200. As illustrated in FIG. 1, the collecting module 500 may be at least partially mounted on the lifting station 200 and connected to the mobile platform 100 indirectly through the lifting station 200. The collecting module 500 moves upwards or downwards along with the lifting station 200 with respect to the mobile platform 100 so as to change a distance between the collecting module 500 and the surface to be cleaned. In the cleaning mode, the lifting station 200 gets down, so that the collecting module 500 is brought close to the cleaning surface. The collecting module 500 collects dirty cleaning liquid remaining on the surface to be cleaned to ensure that the surface to be cleaned is clean. In the non-cleaning mode, the lifting station 200 rises up to make the collecting module 500 move away from the surface to be cleaned, and thus the mobile platform 100 may move on the surface to be cleaned.

As mentioned above, in some embodiments of the present disclosure, the automatic cleaning device 001 further includes a vacuum module 700. The vacuum module 700 is configured to generate a vacuum flow to suction debris into a dust box (not shown in FIG. 1) of the vacuum module 700. The dust box is detachably mounted on the mobile platform 100 for removal and cleaning. The vacuum module 700 includes a vacuum driving device (not shown in FIG. 1) to generate the vacuum flow. The vacuum module 700 further includes a roller brush that cleans dirt and debris into the vacuum module 700 through a rotation. The vacuum module 700 may be connected to the mobile platform 100 directly or indirectly. The vacuum module 700 may be connected to the mobile platform 100 directly, or the vacuum module 700 may be mounted on the lifting station 200 and connected to the mobile platform 100 indirectly through the lifting station 200. As illustrated in FIG. 1, the vacuum module 700 is connected to the mobile platform 100 directly. Alternatively, the vacuum module 700 may be mounted on the lifting station 200, and then connected to the mobile platform 100 indirectly through the lifting station 200. When the vacuum module 700 is mounted on the lifting station 200, the vacuum module 700 is moved upwards or downwards along with the lifting station 200 with respect to the mobile platform 100, so that a distance between the vacuum module 700 and the surface to be cleaned is changed. In the cleaning mode, the lifting station 200 gets down, so that the vacuum module 700 is brought to approach the surface to be cleaned, and the vacuum module 7000 may clean the surface to be cleaned. In the non-cleaning mode, the lifting station 200 rises up to make the vacuum module 700 move away from the surface to be cleaned, and the mobile platform 100 can move on the surface to be cleaned.

As illustrated in FIG. 1, the vacuum module 700 may be disposed in front of the liquid supplying module 400. The collecting module 500 may be disposed behind the liquid supplying module 400. The cleaning module 300 may be disposed between the liquid supplying module 400 and the collecting module 500, and the cleaning module 300 may clean the surface to be cleaned with the cleaning liquid. When the mobile platform 100 moves in the target direction on the surface to be cleaned, the vacuum module 700 may vacuums debris on the surface to be cleaned into the dust box; the liquid supplying module 400 supplies the cleaning liquid to the surface to be cleaned between the vacuum module 700 and the cleaning module 300. The cleaning module 300 cleans the surface to be cleaned with the cleaning liquid, and dirty cleaning liquid after cleaning the surface to be cleaned is remained on the surface to be cleaned; and finally, the collecting module 500 collects the dirty cleaning liquid remaining on the surface to be cleaned into the collecting module 500 to ensure that the surface to be cleaned is clean and free of the dirty cleaning liquid.

The automatic cleaning device 001 can be changed adaptively for different applications, which still falls within the scope of the present disclosure.

Figure 2:
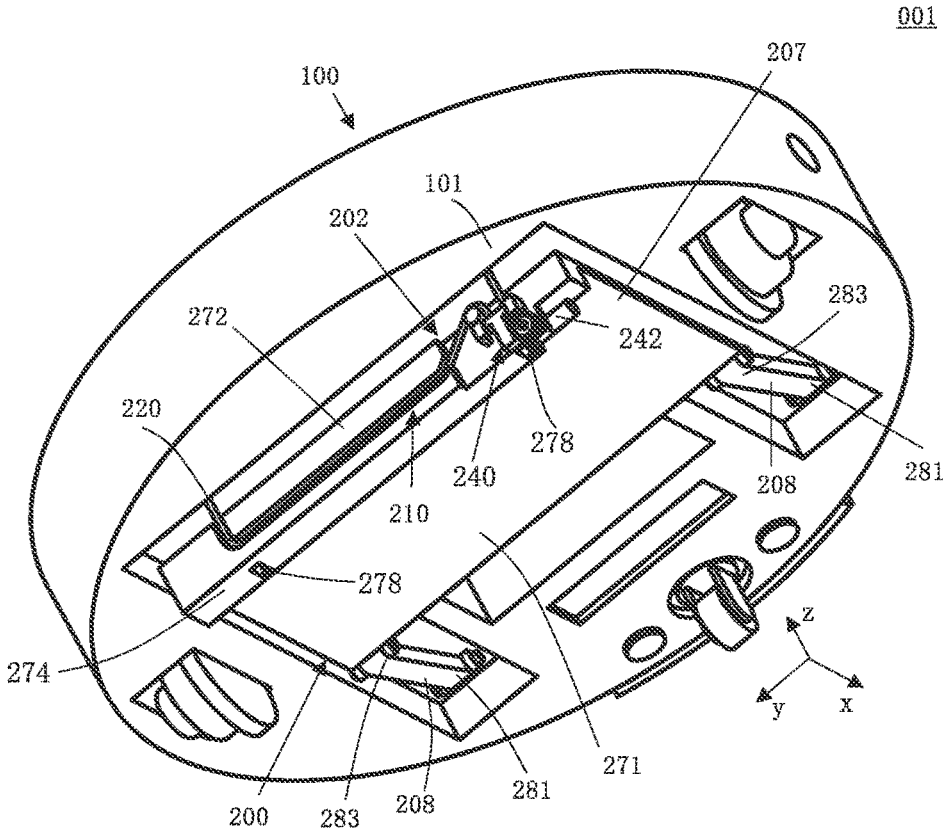
FIG. 2 is a schematic structural view of a lifting station according to some embodiments of the present disclosure.

FIG. 2 illustrates a schematic structural view of a lifting station 200 of an automatic cleaning device 001 according to some embodiments of the present disclosure. FIG. 2 is a view observed from a bottom rear side of the automatic cleaning device 001. The lifting station 200 includes a lifting mechanism 202 and a base 207.

The base 207 is connected to the lifting mechanism 202 and configured to move upwards or downwards with respect to the mobile platform 100 as driven by the lifting mechanism 202. Furthermore, the base 207 includes a first connection end 271 and a second connection end 272. The first connection end 271 is disposed adjacent to a front side of the mobile platform 100; and the second connection end 272 is disposed adjacent to a rear side of the mobile platform 100. The base 207 includes a lower surface 274. The base 207 further includes an auxiliary wheel 278. The auxiliary wheel 278 is configured to assist the base 207 to move on the surface to be cleaned. When the base 207 moves downwards with respect to the mobile platform 100, the auxiliary wheel 278 first touches the surface to be cleaned and then can roll on the surface to be cleaned so as to assist the base 207 to move on the surface to be cleaned, thereby avoiding a dry friction between the base 207 and the surface to be cleaned during the movement of the mobile platform 100. The number of the auxiliary wheels 278 can be one or multiple. FIG. 2 illustrates an example in which there are two auxiliary wheels 278, and of course there may be any quantity of the auxiliary wheel 278, such as one, three, or the like.

The lifting mechanism 202 is connected to the mobile platform 100 and configured to drive the lifting station 200 to move upwards or downwards with respect to the mobile platform 100. When the lifting mechanism 202 is extended, the lifting station 200 moves downwards and is extended; when the lifting mechanism 202 is retracted, the lifting station 200 moves upwards and is retracted.

In some embodiments, the lifting mechanism 202 may include various forms of mechanical structure. For example, the lifting mechanism 202 may be a flexible mechanism that draws the base 207 upwards or downwards through a cable, or may be a rigid pulling mechanism that drives the base 207 to move upwards or downwards through a rigid linear transmitting mechanism. For example, the lifting mechanism 202 illustrated in FIG. 2 is a flexible pulling mechanism. The specific design of the flexible pulling mechanism will be described in connection with FIG. 3.

When the lifting mechanism 202 is a flexible pulling mechanism, the lifting station 200 may further include a connection rod 208. The connection rod 208 includes a first hinge end 281 and a second hinge end 283. The first hinge end 281 of the connection rod 208 is hinged with the mobile platform 100; the second hinge end 283 of the connection rod 208 is hinged with the first connection end 271 of the base 207. The device may have one or more connection rods 208. FIG. 2 illustrates an example in which there are two connection rods 208, wherein the two connection rods 208 are respectively disposed at the left and right sides of the base 207. Of course, there may be any number of connection rods 208, such as one, three, four, five and the like.

The flexible pulling mechanism may be connected to the second connection end 272 of the base 207. The flexible pulling mechanism suspends the base 207 on the mobile platform 100 through a first cable 220, and is configured to draw the base 207 upwards or downwards with respect to the mobile platform 100. An upward movement of the base 207 means that the lower surface 274 of the base 207 moves toward the bottom surface 101 of the mobile platform 100, while a downward movement of the base 207 means that the lower surface 274 of the base 207 moves away from the bottom surface 101 of the mobile platform 100. When the base 207 moves upwards, the second connection end 272 of the base 207 also moves upwards under action of the flexible pulling mechanism, the second hinge end 283 of the connection rod 208 pivots about the first hinge end 281, and the first connection end 271 of the base 207 further pivots about the second hinge end 283 of the connection rod 208. Through pivoting of the connection rod 208, the position of the base 207 in the vertical direction is lowered, and the position of the base 207 in the horizontal direction is also displaced. This displacement is related to a pivoting angle of the connection rod 208. As will be understood from the following description, due to characteristics of flexibly drawing, the flexible pulling mechanism is capable of compensating the displacement of the base 207 in the horizontal direction, thereby ensuring that posture of the base 207 remains unchanged under its own gravity. That is, the connection rod 208 and the flexible pulling mechanism can cooperate to maintain an angle between the lower surface 274 of the base 207 and the bottom surface 101 of the mobile platform 100 constant during the upward and downward movement of the base 207.

Further, the flexible pulling mechanism may include a suspension mechanism 210 and a driving mechanism 240. The suspension mechanism 210 may include a first cable 220 that suspends the base 207 on the mobile platform 100. The driving mechanism 240 is configured to drive the base 207 to move upwards or downwards with respect to the mobile platform 100.

The suspension mechanism 210 and the driving mechanism 240 may cooperate to form various flexible pulling mechanisms to draw the base 207 upwards or downwards with respect to the mobile platform 100. FIGS. 3-7 depict various flexible pulling mechanisms.

Figure 3:
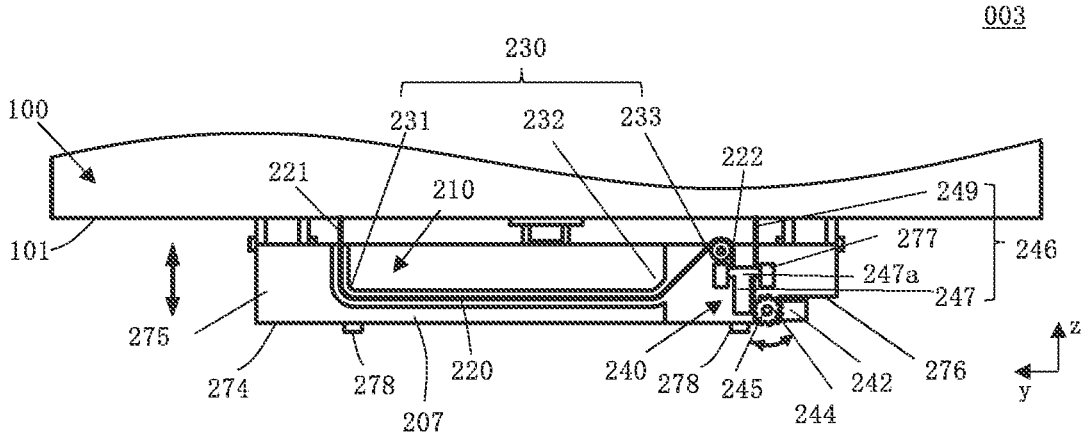
FIG. 3 illustrates a flexible pulling mechanism according to some embodiments of the present disclosure.

FIG. 3 illustrates a flexible pulling mechanism 003 that is applicable to the lifting mechanism 202 in accordance with some embodiments of the present disclosure. As mentioned above, the flexible pulling mechanism 003 includes a suspension mechanism 210 and a driving mechanism 240. The suspension mechanism 210 may include a first cable 220 and at least one cable guide 230. Additionally, a base 207 may further include a first side 275 and a second side 276.

The first cable 220 includes a first end 221 which may be connected to the mobile platform 100 directly or indirectly, and a second end 222 which may be connected to the driving mechanism 240 directly or indirectly.

The cable guide 230 is disposed on the second connection end 272 (as illustrated in FIG. 2) of the base 207 for the first cable 220 passing through. The cable guide 230 may include at least one of the following components: at least one pulley, at least one guide turning, and at least one guide protrusion. In a case that the first cable 220 passes through a cable guide 230, extending direction thereof is changed. As illustrated in FIG. 3, the cable guide 230 includes a first guide turning 231, a second guide turning 232, and a fixed pulley 233. The first guide turning 231 is disposed at or adjacent to the first side 275 of the base 207, the second guide turning 232 is disposed at or adjacent to the second side 276 of the base 207, and the fixed pulley 233 is connected to the base 207 directly or indirectly. The first end 221 of the first cable 220 is connected to the mobile platform 100; the first cable 220 sequentially passes through, from an upper portion of the base 207, the first guide turning 231, the second guide turning 232 and the fixed pulley 233, and finally, the second end 222 of the first cable 220 is connected to the driving mechanism 240. The first end 221 of the first cable 220 and the first guide turning 231 cooperate to define a first direction. The first guide turning 231 and the second guide turning 232 cooperate to define a second direction. The second guide turning 232 and the fixed pulley 233 cooperate to define a third direction. The fixed pulley 233 and the driving mechanism 240 cooperate to define a fourth direction. An angle formed between the first direction and the second direction may be an acute angle, a right angle or an obtuse angle; an angle formed between the second direction and the third direction may be a right angle or an obtuse angle, and an angle formed between the third direction and the fourth direction may be an acute angle. After the first cable 220 passes through the cable guide 230, an extending direction of the second end 222 of the first cable 220 is changed, so the extending direction of the second end 222 and an extending direction of the first end 221 are different. As illustrated in FIG. 3, the extending direction of the first end 221 orients toward the mobile platform 100, and the extending direction of the second end 222 orients away from the mobile platform 100.

The driving mechanism 240 may include a power device 242, a driving wheel 244, and a driving coupler 246. The power device 242 may be an electric motor, an engine, or a cylinder configured to supply power to the driving wheel 244. The driving wheel 244 may be connected to the power device 242 directly, or may be connected to the power device 242 indirectly via one or more of a gear mechanism, a worm gear mechanism, a gear rack mechanism, etc. The driving wheel 244 may be mounted on the mobile platform 100 or on the base 207 alternatively. As illustrated in FIG. 3, the driving wheel 244 is rotabably connected to the base 207, and is rotatable about an axle 245. The driving coupler 246 may be connected to the mobile platform 100 directly or indirectly, and may be coupled to the driving wheel 244. As the driving wheel 244 rotates, the driving wheel 244 moves linearly with respect to the driving coupler 246.

As illustrated in FIG. 3, the driving wheel 244 is a gear, and the driving coupler 246 includes a rack 247. The rack 247 is connected to the mobile platform 100 directly or indirectly. As illustrated in FIG. 3, the driving coupler 246 includes a connection cable 249. The rack 247 is hanged below the mobile platform 100 by the connection cable 249. Furthermore, the rack 247 includes a sliding end 247*a*. The base 207 is provided with a sliding slot 277. The rack 247 is slidably connected to the sliding slot 277 through the sliding end 247*a*, and is movable in an extending direction of the sliding slot 277.

When the power device 242 drives the gear to rotate counterclockwise, the gear is meshed with the rack 247 and the gear moves upwards with respect to the rack 247, such that the base 207 to which the gear is connected moves upwards with respect to the rack 247. The rack 247 is hanged below the mobile platform 100 by the connection cable 249. Due to the gravity of the base 207, the rack 247 is hanged below the mobile platform 100 for all the time, and a distance between the rack 247 and the mobile platform 100 is therefore unchanged. As a result, the base 207 moves upwards with respect to the mobile platform 100, and the lower surface 274 of the base 207 approaches the bottom surface 101 of the mobile platform 100. When the gear rotates clockwise, as the gear is meshed with the rack 247, the gear thus moves downwards with respect to the rack 247, so that the base 207 moves downwards with respect to the rack 247. Due to the gravity of the base 207, the rack 247 is hanged below the mobile platform 100 all the time, and the distance between the rack 247 and the mobile platform 100 is therefore unchanged. As a result, the base 207 moves downwards with respect to the mobile platform 100, and the lower surface 274 of the base 207 moves away from the bottom surface 101 of the mobile platform 100.

Figure 4:
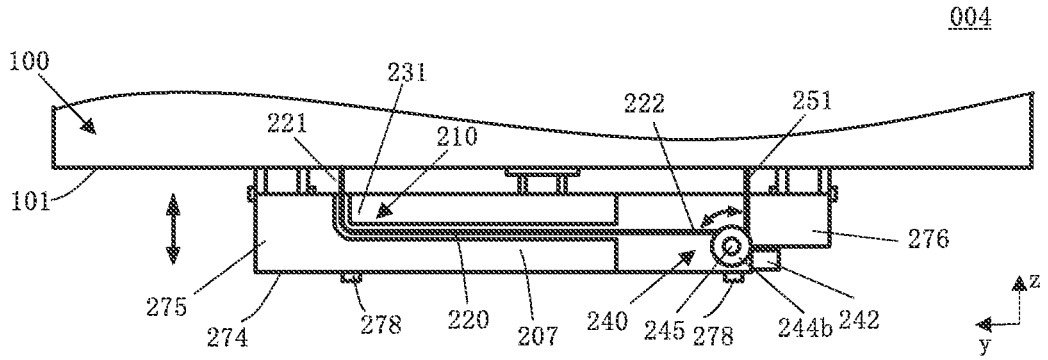
FIG. 4 illustrates a flexible pulling mechanism according to some embodiments of the present disclosure.

FIG. 4 illustrates a flexible pulling mechanism 004 that is applicable to a lifting mechanism 202 in accordance with some embodiments of the present disclosure. As mentioned above, the flexible pulling mechanism 004 may include a suspension mechanism 210 and a driving mechanism 240. The suspension mechanism 210 may include a first cable 220 and at least one cable guide 230.

As illustrated in FIG. 4, the cable guide 230 includes a first guide turning 231. The first guide turning 231 is disposed at or adjacent to the first side 275 of the base 207. A first end 221 of the first cable 220 is connected to the mobile platform 100; the first cable 220 passes through the first guide turning 231 from an upper portion of the base 207; and finally, a second end 222 of the first cable 220 is connected to the driving mechanism 240. The first end 221 of the first cable 220 and the first guide turning 231 cooperate to define a first direction, and the first guide turning 231 and the driving mechanism 240 cooperate to define a second direction. An angle formed between the first direction and the second direction may be an acute angle, a right angle or an obtuse angle.

As mentioned above, the driving mechanism 240 may include a power device 242, a driving wheel 244, and a driving coupler 246. The driving wheel may be a reel 244*b*. The reel 244*b* is rotabably connected to the base 207 and is rotatable about the axle 245. The driving coupler 246 may include a second cable 251. A first end of the second cable 251 is fixed to the mobile platform 100 and a second end of the second cable 251 is wound around the reel 244*b*. A second end 222 of the first cable 220 is wound around the reel 244*b*. When the reel 244*b* rotates clockwise, the second cable 251 and the second end 222 of the first cable 220 are wound around the reel 244*b*. Consequently, a length of an unwound portion of the cable located between the reel 244*b* and the mobile platform 100 is reduced such that the base 207 is drawn upwards with respect to the mobile platform 100, and the lower surface 274 of the base 207 moves toward the bottom surface 101 of the mobile platform 100. When the reel 244*b* rotates counterclockwise, the second cable 251 and the first cable 220 are unwound from the reel 244*b*. Consequently, a length of the unwound portion of the cable between the reel 244*b* and the mobile platform 100 is increased. Due to the gravity, the base 207 moves downwards with respect to the mobile platform 100, and the lower surface 274 of the base 207 moves away from the bottom surface 101 of the mobile platform 100.

Figure 5:
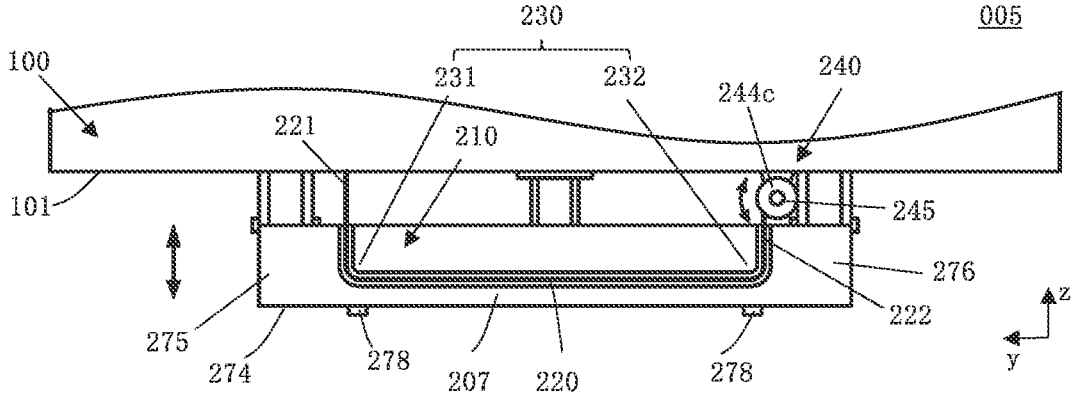
FIG. 5 illustrates a flexible pulling mechanism according to some embodiments of the present disclosure.

FIG. 5 illustrates a flexible pulling mechanism 005 that is applicable to a lifting mechanism 202 in accordance with some embodiments of the present disclosure. As mentioned above, the flexible pulling mechanism 005 may include a suspension mechanism 210 and a driving mechanism 240. The suspension mechanism 210 includes a first cable 220 and at least one cable guide 230.

As illustrated in FIG. 5, the cable guide 230 includes a first guide turning 231 and a second guide turning 232. The first guide turning 231 may be disposed at or adjacent to a first side 275 of the base 207, and the second guide turning 232 may be disposed at or adjacent to a second side 276 of the base 207. A first end 221 of a first cable 220 is connected to the mobile platform 100; the first cable 220 may, from an upper portion of the base 207, sequentially pass through the first guide turning 231 and the second guide turning 232, and finally, a second end 222 of the first cable 220 is connected to the driving mechanism 240. The first end 221 of the first cable 220 and the first guide turning 231 cooperate to define a first direction. The first guide turning 231 and the second guide turning 232 cooperate to define a second direction. The second guide turning and the driving mechanism 240 cooperate to define a third direction. An angle formed between the first direction and the second direction may be an acute angle, a right angle or an obtuse angle. An angle formed between the second direction and the third direction may be a right angle or an obtuse angle.

As mentioned above, the driving mechanism 240 may include a power device 242 (which is not shown in FIG. 5), and a driving wheel 244. The driving wheel 244 may be mounted on the mobile platform 100 or may be mounted on the base 207 alternatively. As illustrated in FIG. 5, the driving wheel 244 is rotabably connected to the mobile platform 100 and is rotatable about the axle 245. The driving wheel 244 may be a reel 244*c*. A first end 221 of a first cable 220 is connected to the mobile platform; from an upper portion of the base 207, the first cable 220 sequentially pass through the first guide turning 231 and the second guide turning 232, and finally, a second end 222 of the first cable 220 is wound around the reel 244*c*.

When the reel 244*c* rotates clockwise, the second end 222 of the first cable 220 is wound around the reel 244*c*, such that a length of an unwound portion of the cable between the reel 244*c* and the first end 221 of the first cable 220 is reduced. Consequently, the base 207 moves upwards with respect to the mobile platform 100, and a lower surface 274 of the base 207 moves toward a bottom surface 101 of the mobile platform 100. When the reel 244*c* rotates counterclockwise, the first cable 220 is unwound from the reel 244*c*. Accordingly, the length of the unwound portion of the cable between the reel 244*c* and the first end 221 of the first cable 220 is increased. Due to the gravity, the base 207 moves downwards with respect to the mobile platform 100, and the lower surface 274 of the base 207 moves away from the bottom surface 101 of the mobile platform 100.

FIGS. 3, 4 and 5 illustrate three flexible pulling mechanisms 003, 004 and 005 in accordance with some embodiments of the present disclosure. A cable guide 230 of the flexible pulling mechanism 003 illustrated in FIG. 3 includes a groove guide and a fixed pulley. The cable guide 230 of the flexible pulling mechanism 004 and 005 illustrated in FIGS. 4 and 5 includes a groove guide. As mentioned above, the cable guide 230 includes at least one of following components: at least one pulley, at least one guide turning, and at least one guide protrusion. Alternatively, the cable guide 230 includes a guide protrusion, or a guide protrusion together with a fixed pulley.

Figure 6:
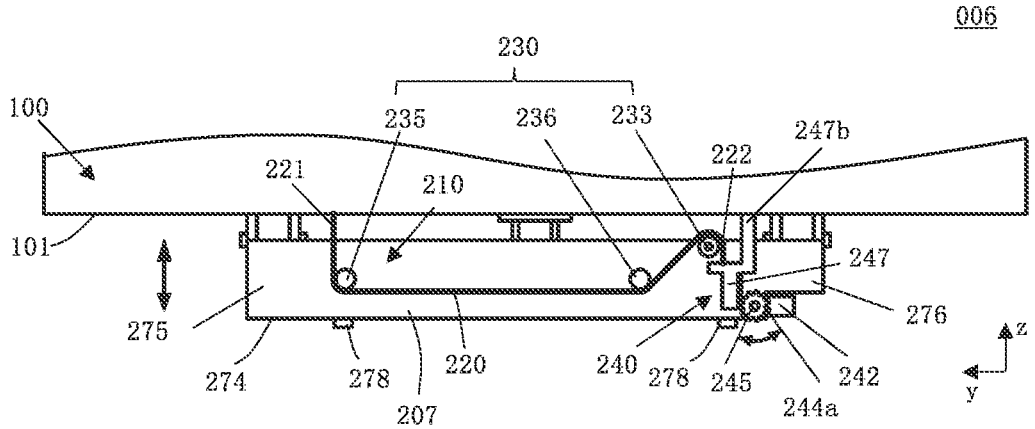
FIG. 6 illustrates a suspension mechanism according to some embodiments of the present disclosure.

FIG. 6 illustrates a suspension mechanism 006 in accordance with some embodiments of the present disclosure. The suspension mechanism 006 is applicable to a flexible pulling mechanism 003 illustrated in FIG. 3.

As illustrated in FIG. 6, the cable guide 230 may include a first guide protrusion 235, a second guide protrusion 236, and a fixed pulley 233. The first guide protrusion 235 may be disposed at or adjacent to a first side 275 of the base 207, the second guiding protrusion 236 may be disposed at or adjacent to a second side 276 of the base 207, and the fixed pulley 233 is connected to the base 207 directly or indirectly. A first end 221 of the first cable 220 is connected to the mobile platform 100, from an upper portion of the base 207, the first cable 220 sequentially passes through the first guide protrusion 235, the second guide protrusion 236 and the fixed pulley 233, and finally, a second end 222 of the first cable 220 is connected to the driving mechanism 240.

As mentioned above, the rack 247 may be connected to the mobile platform 100 directly or indirectly. The rack 247 may include a connection end 247*b*. As illustrated in FIG. 6, the connection end 247*b* is connected to the mobile platform 100 directly. When the gear rotates counterclockwise, the gear is meshed with the rack 247, and the gear moves upwards with respect to the rack 247, so that the base 207 to which the gear is connected moves upwards with respect to the rack 247. The rack 247 is connected to the mobile platform 100, thus the base 207 moves upwards with respect to the mobile platform 100, and a lower surface 274 of the base 207 approaches a bottom surface 101 of the mobile platform 100. When the gear rotates clockwise, the gear is meshed with the rack 247, and the gear moves downwards with respect to the rack 247, so that the base 207 moves downwards with respect to the rack 247. As the rack 247 is connected to the mobile platform 100, the base 207 moves downwards with respect to the mobile platform 10, and the lower surface 274 of the base 207 moves away from the bottom surface 101 of the mobile platform 100.

Figure 7:
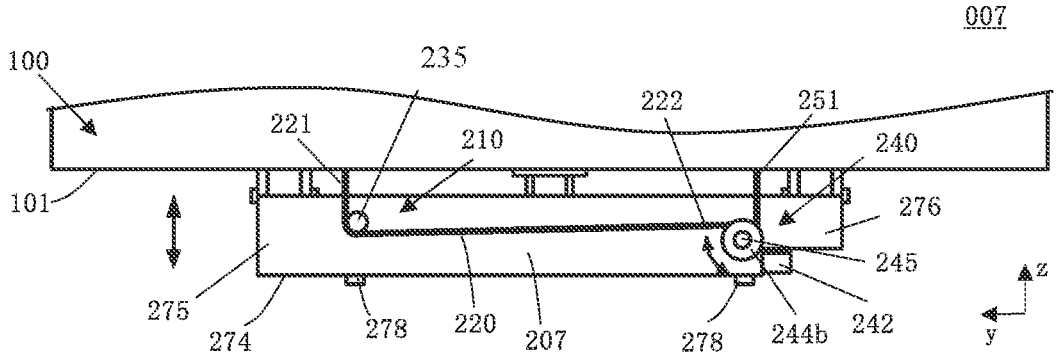
FIG. 7 illustrates a suspension mechanism according to some embodiments of the present disclosure.

FIG. 7 illustrates a suspension mechanism 007 in accordance with some embodiments of the present disclosure. The suspension mechanism 007 is applicable to a flexible pulling mechanism 004 illustrated in FIG. 4.

As illustrated in FIG. 7, a cable guide includes a first guide protrusion 235. The first guide protrusion 235 may be disposed at or adjacent to a first side 275 of the base 207. A first end 221 of the first cable 210 is connected to the mobile platform; the first cable 210 then passes through the first guide protrusion 235 from an upper portion of the base 207, and finally, a second end 222 of the first cable 210 is connected to the driving mechanism 240.

When a reel 244*b* rotates clockwise, a second cable 251 and the second end 222 of the first cable 210 are wound around the reel 244*b*. Accordingly, a length of an unwound portion of the cable between the reel 244*b* and the mobile platform 100 is reduced, and the base 207 is drawn to move upwards with respect to the mobile platform 100, and a lower surface 274 of the base 207 moves toward a bottom surface 101 of the mobile platform 100. When the reel 244*b* rotates counterclockwise, the second cable 251 and the first cable 220 are unwound from the reel 244*b*, such that the length of the unwound portion of the cable between the reel 244*b* and the mobile platform 100 is increased. Due to the gravity, the base 207 moves downwards with respect to the mobile platform 100, and the lower surface 274 of the base 207 moves away from the bottom surface 101 of the mobile platform 100.

Figure 8:
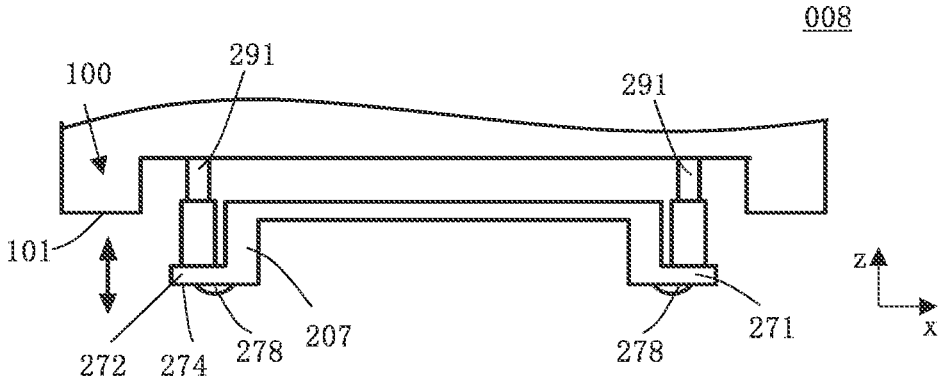
FIG. 8 is a schematic structural view of a lifting station according to some embodiments of the present disclosure.

As mentioned above, the lifting mechanism 202 may have various forms of mechanical structure. For example, the lifting mechanism 202 may be a flexible pulling mechanism that moves the base 207 upwards or downwards through a cable, or a rigid mechanism that drives the base 207 to move upwards or downwards through a rigid linear transmitting mechanism. FIG. 8 illustrates a schematic structural view of a lifting mechanism 008, viewed from a right side of the automatic cleaning device 001, according to some embodiments of the present disclosure. The lifting mechanism 008 is applicable to the lifting station 200.

The lifting station 200 includes a lifting mechanism 008 and a base 207. The lifting mechanism 008 includes at least two linear driving mechanisms 291. The linear driving mechanism 291 may comprise an electric push rod, a lead screw nut, a cylinder, or the like. One end of the linear driving mechanism 291 is connected to the base 207 directly or indirectly, and the other end of the linear driving mechanism 291 is connected to the mobile platform 100 directly or indirectly. The linear driving mechanism 291 is arranged between a first connection end 271 of the base 207 and a second connection end 272 of the base 207. When the linear driving mechanism 291 moves forwards, a distance between the base 207 and the mobile platform 100 increases, and a lower surface 274 of the base 207 moves away from a bottom surface 101 of the mobile platform 100. When the linear driving mechanism 291 moves backwards, the distance between the base 207 and the mobile platform 100 decreases, and the lower surface 274 of the base 207 moves toward the bottom surface 101 of the mobile platform 100.

Figure 9:
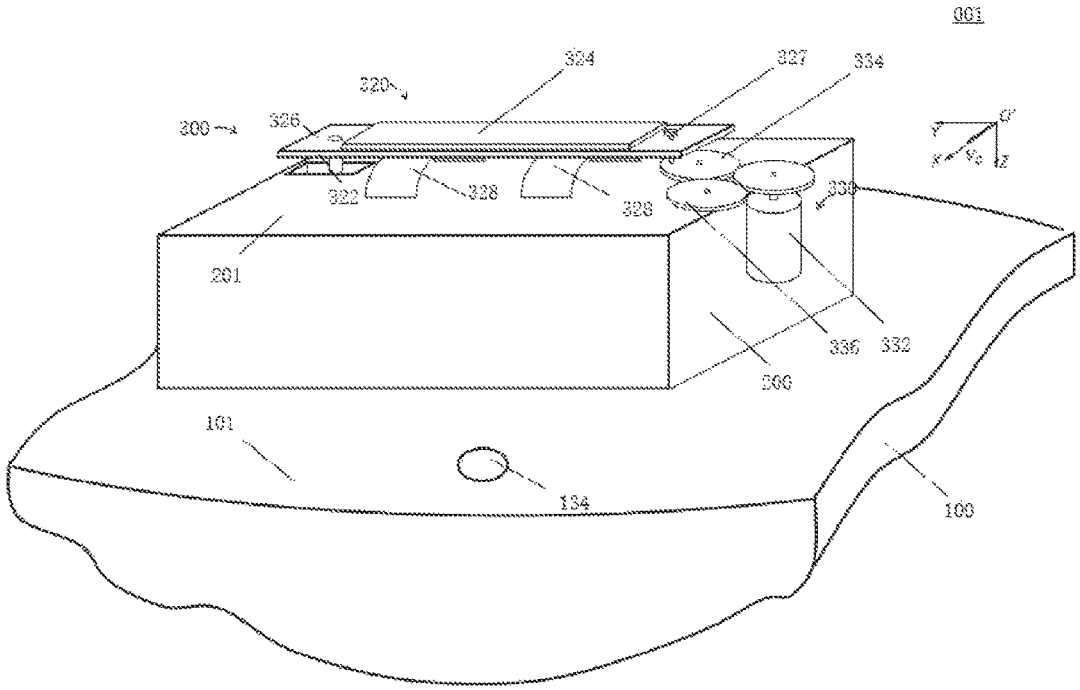
FIG. 9 is a schematic structural view of a cleaning module of an automatic cleaning device according to an embodiment of the present disclosure.

FIG. 9 illustrates a structural view of a cleaning module 300 of the automatic cleaning device 001 according to embodiments of the present disclosure. The automatic cleaning device 001 is upside-down in FIG. 9.

The cleaning module 300 may be mounted on the mobile platform 100, or may be mounted on the lifting station 200. Furthermore, the cleaning module 300 includes a cleaning-head 320 and a driving unit 330.

The cleaning-head 320 is mounted on a lower surface 201 of the lifting station 200. The cleaning-head 320 is configured to clean a surface to be cleaned, for example, a floor. In some embodiments of the present disclosure, the cleaning-head 320 has a plate-like structure. The plate-like structure may have any shape, such as rectangular, square, circular, or irregular. In some embodiments of the present disclosure, since a distance between the lifting station 200 and the mobile platform 100 is adjustable, a distance between the cleaning-head 320 and a bottom surface 101 of the mobile platform 100 is adjustable. Furthermore, the cleaning-head 320 may be made of an elastic material, and may be supported by an elastic support structure 328, such as a leaf spring, which is disposed between the bottom surface 201 of the lifting station 200 and the cleaning-head 320. When the cleaning-head 320 performs cleaning operation, the cleaning-head 320 is kept in constant contact with the surface to be cleaned. A distance between the surface to be cleaned and the lower surface 201 of the lifting station 200 may not be constant when the mobile platform 100 is in the process of automatic and/or autonomous cruising. Elasticity of the cleaning-head 320 allows the distance between the cleaning-head 320 and the lower surface 201 of the lifting station 200 to be passively adapted according to the surface to be cleaned.

For example, the distance between the cleaning-head 320 and the bottom surface 101 of the mobile platform 100 may be adjusted automatically and dynamically according to a contour of the surface to be cleaned. As an example, when the surface to be cleaned is a sloping surface from high to low, the distance between the cleaning-head 320 and the lower surface 201 of the lifting station 200 may gradually increase as the mobile platform cruises forwards. The elastic support structure 328 can make the cleaning-head 320 move downwards so as to keep the cleaning-head 320 in contact with the surface to be cleaned for all times.

The cleaning-head 320 includes a cleaning-head base board 322 and a working-head 324. The working-head 324 is mounted on the cleaning-head base board 322. When the automatic cleaning device 001 is in operation, the working-head 324 is in contact with the surface to be cleaned. The working-head 324 is configured to clean the surface to be cleaned. For example, the working-head 324 may be a brush, a piece of rag, a piece of sponge, or any other tool and/or material that may clean the surface to be cleaned. The working-head 324 may have any shape, or its shape may at least partly conform to a shape of the cleaning-head base board 322. As shown in FIG. 9, the working-head 324 has a board shape the periphery of which at least partly conforms to that of the cleaning-head base board 322.

The driving unit 330 is connected to the cleaning-head 320 directly or indirectly and is configured to drive the cleaning-head 320 to conduct reciprocating movement. The driving unit 330 includes an engine 332 (e.g., a motor), a driving wheel 334 and a gear mechanism 336. The gear mechanism 336 is connected between the engine 332 and the driving wheel 334. The engine 332 is configured to drive the driving wheel 334 directly to conduct swing movements, or alternatively, the engine 332 is configured to drive the driving wheel 334 indirectly through the gear mechanism 336 to conduct the swing movements. The gear mechanism 336 is illustrated as a single gear in FIG. 9. However, one of ordinary skill in the art should understand that the gear mechanism 336 may be a mechanism with multiple gears.

The driving wheel 334 may be connected with the cleaning-head 320 directly or indirectly, thereby driving the cleaning-head 320 to conduct reciprocating movement on a target surface. The target surface indicates a plane on which the cleaning-head 320 conducts the reciprocating movement. In some embodiments of the present disclosure, the target surface may be a plane parallel to the lower surface 201 of the lifting station 200. For example, when the automatic cleaning device 001 is in operation on a floor, the cleaning-head 320 is kept in tight contact with the floor, then the target surface is the surface to be cleaned, that is, the floor. On the other hand, in some embodiments of the present disclosure, the target surface may be a plane different from the surface to be cleaned. For example, when the automatic cleaning device 001 parks on the floor with no operation, the lifting station 200 lifts up, then the cleaning-head 320 is not in contact with the floor, and the target surface is a virtual plane other than the floor.

The reciprocating movement is periodic. In some embodiments of the present disclosure, the reciprocating movement includes a motion component perpendicular to the target direction. In some embodiments, the reciprocating movement includes a motion component parallel to the target direction. As illustrated in FIG. 9, a coordinate system is established by taking a point on the automatic cleaning device 001 as an origin so as to measure movement of the automatic cleaning device 001. In the coordinate system, a direction of the x-axis indicates the target direction in which the automatic cleaning device 001 moves at a speed V0, and a direction of the y-axis is perpendicular to the direction of the x-axis. In some embodiments of the present disclosure, the reciprocating movement includes a motion component perpendicular to the target direction (i.e., the direction of the Y-axis). In some embodiments of the present disclosure, the reciprocating movement includes a motion component parallel to the target direction (i.e. the direction of the x-axis direction). In some embodiments of the present disclosure, the reciprocating movement includes both a motion component perpendicular to the target direction and a motion component parallel to the target direction.

The reciprocating movement may be a periodical motion with a preset reciprocating cycle. Herein, the preset reciprocating cycle indicates an interval of time required for the cleaning-head 320 to complete one cycle of the reciprocating movement. It should be understood that the longer the preset reciprocating cycle is, the slower the cleaning-head 320 moves, and the lower the cleaning strength/efficiency of the automatic cleaning device 001 is; and the shorter the preset reciprocating cycle is, the faster the cleaning-head 320 moves, and the higher the cleaning strength/efficiency of the automatic cleaning device 001 is.

The cleaning strength/efficiency of the automatic cleaning device 001 may be adjusted automatically and dynamically according to operation environment of the automatic cleaning device 001. For example, the automatic cleaning device 001 may detect physical information of the surface to be cleaned through a sensor 134 disposed at a bottom of the mobile platform 100. For example, the sensor 134 detects information such as flatness of the surface to be cleaned, material of the surface to be cleaned, and whether the surface to be cleaned is greasy or dusty, etc., and then transmits the information to the control module 120 of the automatic cleaning device 001. Accordingly, the control module 120 controls the automatic cleaning device 001 to automatically and dynamically adjust a rotating speed of the engine 332 according to the detected information which corresponds to the operation environment of the automatic cleaning device 001, thereby adjusting the preset reciprocating cycle of the reciprocity movement of the cleaning-head 320.

For example, when the automatic cleaning device 001 operates on a flat floor, the preset reciprocating cycle is automatically and dynamically adjusted to be relatively long, and when the automatic cleaning device 001 operates on a less flat floor, the preset reciprocating cycle is automatically and dynamically adjusted to be relatively short. It is difficult for an uneven floor to be cleaned than a flat floor, so a relatively fast reciprocating movement (i.e. a relatively high frequency) of the cleaning-head is required for cleaning an uneven floor.

For example, when the automatic cleaning device 001 operates on a desktop, the preset reciprocating cycle is automatically and dynamically adjusted to be relatively long, and when the automatic cleaning device 001 operates on a floor, the preset reciprocating cycle is automatically and dynamically adjusted to be relatively short. Usually, the desktop is less dusty and greasy than the floor, and it is easier for the material of the desktop to be cleaned, so less reciprocating movement is required for the cleaning-head 320 to clean up the desktop.

It should be understood that, in addition to that the preset reciprocating cycle is adjusted automatically and dynamically by the automatic cleaning device 001, the preset reciprocating cycle may be adjusted manually or according to a program preset by the system, alternatively.

In some embodiments of the present disclosure, the cleaning module 300 further includes an elastic support structure which is disposed on a back side of the cleaning-head 320 and is configured to support the cleaning-head 320 elastically. As illustrated in FIG. 9, the elastic support structure includes two elastic supports 328 mounted between the lower surface 201 of the lifting station 200 and a back side of the cleaning-head base board 322 to support to the cleaning-head 320 elastically. As mentioned above, the distance between the surface to be cleaned and the bottom surface 201 of the lifting station 200 is not constant when the mobile platform 100 cruises automatically and/or autonomously. The elasticity of the cleaning-head 320 makes the distance between the cleaning-head 320 and the lower surface 201 of the lifting station 200 be passively adjustable along the surface to be cleaned. At the same time, due to elastic support at the back side of the cleaning-head 320 by the elastic supports 328, the cleaning-head 320 is kept tight contact with the surface to be cleaned, thus ensuring a great cleaning strength of the automatic cleaning device 001 on the surface to be cleaned. In order to make the cleaning-head 320 in tight contact with the surface to be cleaned during operation, the elastic support 328 is kept in a deformed state when the cleaning-head 320 cleans the surface to be cleaned, so as to apply an elastic force to the cleaning-head base board 322 from the back of the cleaning-head base board 322 in a direction toward the surface to be cleaned. In addition, when the surface to be cleaned is not even, for example, when the cleaning-head 320 passes through an object on the surface to be cleaned, pressures received from the surface to be cleaned by various positions of the cleaning-head 320 (or, of the cleaning-head base board 322) differ. However, due to the elasticity of the cleaning-head base board 322 and presence of the elastic support 328, the distance between the cleaning-head 320 and the bottom surface 201 of the lifting station 200 is elastically adjustable within a certain range, thereby avoiding the pressure from the surface to be cleaned to be concentrated at one point of the surface of the cleaning-head 320. As a result, the cleaning-head 320 becomes more durable.

In some embodiments of the present disclosure, the driving unit 330, the cleaning-head base board 322 and the lifting station 200 may be combined to form a variety of driving mechanisms to drive the cleaning-head 320 to perform the reciprocating movement, which includes a component perpendicular to the target direction. FIGS. 10 to 13 depict some examples of the cleaning-head driving mechanisms.

Figure 10:
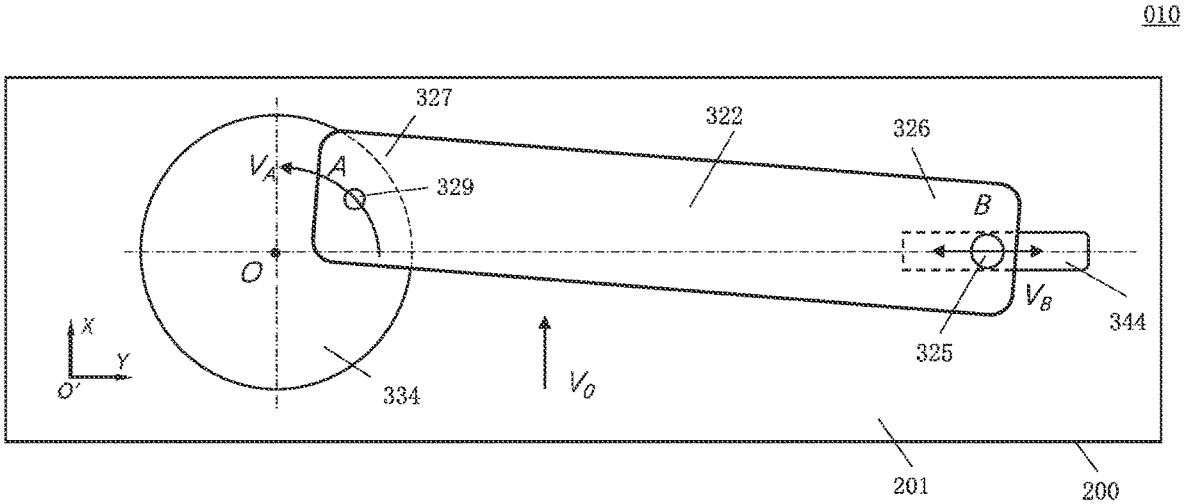
FIG. 10 illustrates a cleaning-head driving mechanism according to some embodiments of the present disclosure.

FIG. 10 illustrates a cleaning-head driving mechanism 010 based on a slider-crank mechanism according to an embodiment of the present disclosure. The driving mechanism 010 may be applicable to the driving mechanism 300. The driving mechanism 010 includes a driving wheel 334, a cleaning-head base board 322 and a groove 344.

The groove 344 is provided on a bottom surface 201 of a lifting station 200. The cleaning-head base board 322 includes a swing end 327 and a sliding end 326. The swing end 327 is connected to the driving wheel 334 via a pivot 329. Point O is a swing center of the driving wheel 334, and point A is a pivot center of the swing end 327. Points O and A do not coincide with each other, and a distance between points O and A is a preset distance. The sliding end 326 includes a slider 325. The slider 325 is a protrusion on the sliding end 326. The slider 325 is inserted in the groove 344 and is slidable along the groove 344. Therefore, the driving wheel 334, the cleaning-head base board 322 and the slider 325 and the groove 344 together form the slider-crank mechanism.

When the driving wheel 334 rotates, point A conducts a circular swing motion. Accordingly, the swing end 327 of the cleaning-head base board 322 follows point A to conduct a circular swing motion, while the slider 325 slides in the groove 344 to conduct a back-and-forth linear motion, resulting in the reciprocating movement of the cleaning-head base board 322. According to some embodiments of the present disclosure, the groove 344 is approximately perpendicular to the target direction of the moving speed of the mobile platform 100, so the linear movement of the sliding end 326 includes a component perpendicular to the target direction, and the circular swing motion of the swing end 327 includes both a component perpendicular to the target direction and a component parallel to the target direction.

In FIG. 10, the mobile platform 100 moves at a speed of V0 in the target direction, while the groove 344 is substantially perpendicular to the target direction. Accordingly, the reciprocating movement of the cleaning-head base board 322 as a whole includes both a motion component perpendicular to the target direction of the automatic cleaning device 001 and a motion component parallel to the target direction of the automatic cleaning device 001.

Figure 11:
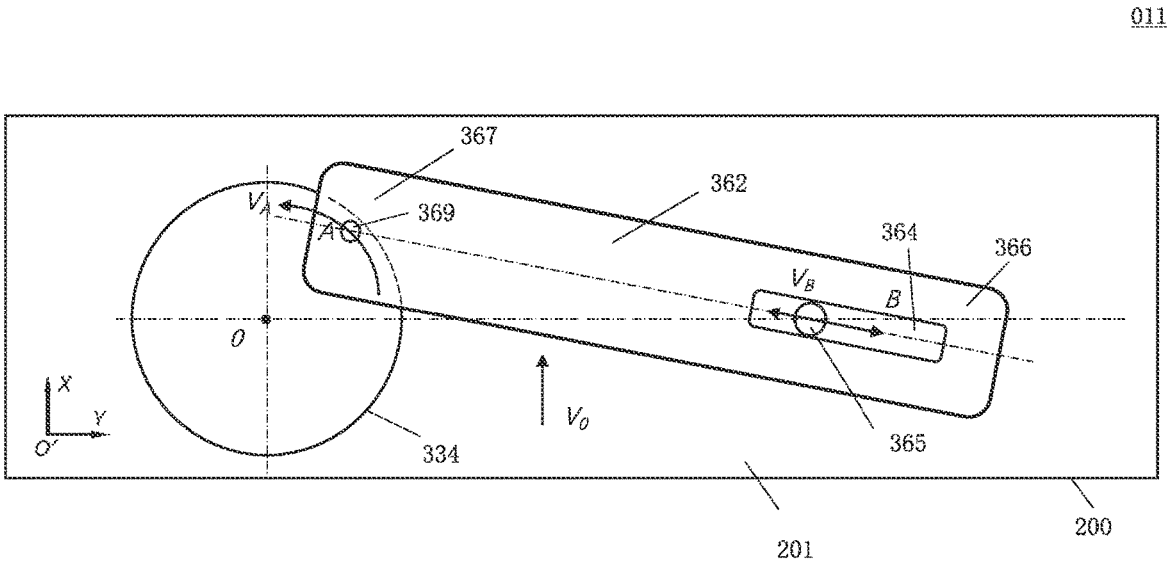
FIG. 11 illustrates a cleaning-head driving mechanism according to some embodiments of the present disclosure.

FIG. 11 illustrates another cleaning-head driving mechanism 011 based on a slider-crank mechanism according to embodiments of the present disclosure. The driving mechanism 011 is applicable to the cleaning module 300. The driving mechanism 011 includes a driving wheel 334, a cleaning-head base board 362 and a slider 365.

The slider 365 is mounted on the lower surface 201 of the lifting station 200 and is a protrusion on the lower surface 201. The cleaning-head base board 362 includes a swing end 367 and a sliding end 366. The swing end 367 is connected to the driving wheel 334 via a pivot 369. A swing center of the driving wheel 334 is O, and a pivot center of the swing end 367 is point A. The points O and A do not coincide with each other, and a distance between the point O and the point A is a preset distance. The sliding end 366 includes a groove 364. The groove 364 sleeves over the slider 365. The slider 365 is disposed in the groove 364 and is slidable along the groove 364. Therefore, the driving wheel 334, the cleaning-head base board 362, the slider 365 and the groove 364 form a slider-crank mechanism.

When the driving wheel 334 rotates, the point A conducts a circular swing motion. Accordingly, the swing end 367 of the cleaning-head base board 362 follows the point A to conduct a circular swing movement, while the groove 364 slides back and forth with respect to the slider 365. Consequently, the cleaning-head base board 362 conducts a reciprocating movement. Thus, the movement of the sliding end 366 includes a component perpendicular to the direction of V0 and a component parallel to the direction of V0, while the circular swing movement of the swing end 367 includes both a component perpendicular to the direction of V0 and a component parallel to the direction of V0. In FIG. 11, the mobile platform 100 moves at the speed of V0 in the target direction. Accordingly, the reciprocating movement of the cleaning-head base board 362 as a whole includes both a motion component perpendicular to the target direction of the automatic cleaning device 001 and a motion component parallel to the target direction of the automatic cleaning device 001.

Figure 12:
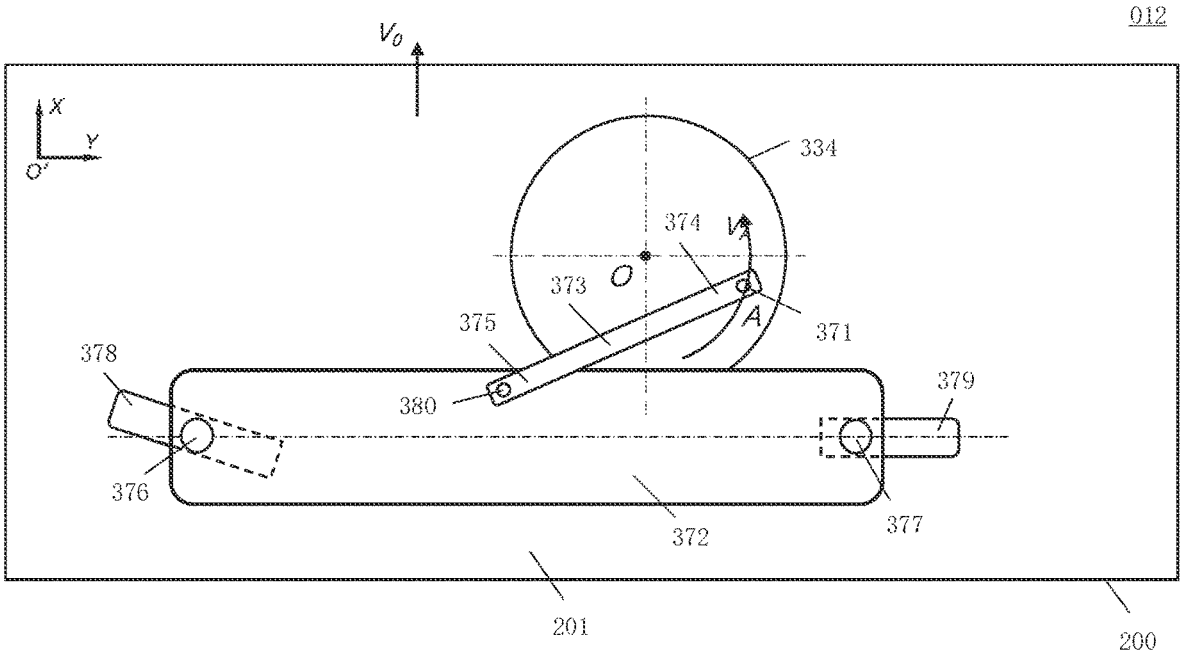
FIG. 12 illustrates a cleaning-head driving mechanism according to some embodiments of the present disclosure.

FIG. 12 illustrates another cleaning-head driving mechanism 012 based on a slider-crank mechanism according to embodiments of the present disclosure. The driving mechanism 012 is applicable to the cleaning module 300. The driving mechanism 012 includes a driving wheel 334, a connection rod 373, a cleaning-head base board 372, a groove 378 (a first groove) and a groove 379 (a second groove).

The grooves 378, 379 are provided on a lower surface 201 of the lifting station 200. The cleaning-head base board 372 includes a slider 376 (first slider) and a slider 377 (second slider) at its respective ends. The sliders 376 and 377 are protrusions arranged at the respective ends of the cleaning-head base board 372. The slider 376 is inserted into the groove 378 and is slidable along the groove 378; and the slider 377 is inserted into the groove 379, and is slidable along the groove 379. In some embodiments of the present disclosure, the groove 378 and the groove 379 are arranged on a same line. And in some embodiments of the present disclosure, the groove 378 and the groove 379 are arranged on different lines. In some embodiments of the present disclosure, the groove 378 and the groove 389 are extended in a same direction. In some embodiments of the present disclosure, the extending direction of the groove 378 and the groove 389 is the same as an extending direction of the cleaning-head base board 372. In some embodiments of the present disclosure, the extending direction of the groove 378 and the groove 389 is different from the extending direction of the cleaning-head base board 372. In some embodiments of the present disclosure, the groove 378 and the groove 379 are extended in different directions. For example, as illustrated in FIG. 12, the extending direction of groove 379 is the same as the extending direction of the cleaning-head base board 372, while the extending direction of groove 378 has an angle with the extending direction of groove 379.

The connection rod 373 includes a swing end 374 and a sliding end 375. The swing end 374 is connected with the driving wheel 334 via a pivot 371; and the sliding end 375 is connected with the cleaning-head base board 372 via a pivot 380.

A swing center of the driving wheel 334 is point O and a pivot center of pivot 371 is point A. The points O and A do not coincide with each other, and the distance between the points O and A may be a preset distance.

When the driving wheel 334 rotates, point A then conducts a circular swing motion. Accordingly, the swing end 374 conducts a circular swing motion, following point A, and then the sliding end 375 drives the cleaning-head base board 372 through the pivot 380 to conduct a sliding motion. Accordingly, the slider 376 of the cleaning-head base board 372 conducts a linear reciprocating movement along the groove 378, and the slider 377 conducts a linear reciprocating movement along the groove 379. In FIG. 12, the mobile platform 100 moves at a speed of V0 in the target direction. According to some embodiments of the present disclosure, when the groove 379 and groove 378 are approximately perpendicular to the direction of V0 of the mobile platform 100 respectively, overall displacement of the cleaning-head base board 372 is substantially perpendicular to the target direction. In other embodiments of the present disclosure, when any one of the groove 379 and the groove 378 has an angle other than 90 degrees with respect to the target direction, the overall displacement of the cleaning-head base board 372 includes both a motion component perpendicular to the target direction and a motion component parallel to the target direction.

Figure 13:
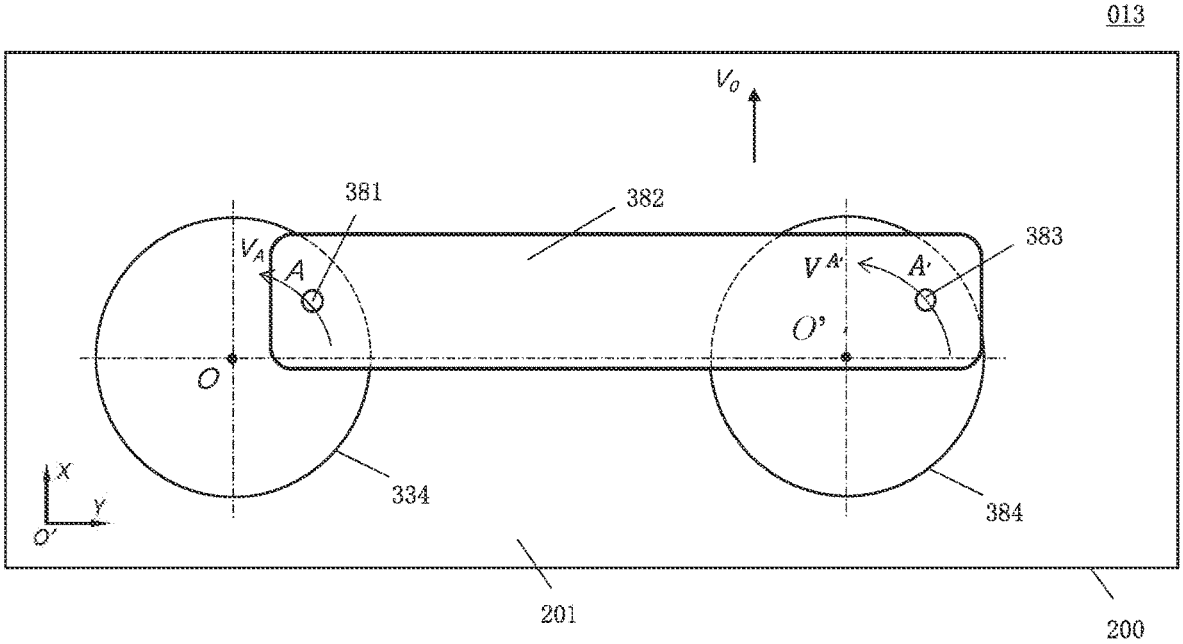
FIG. 13 illustrates a cleaning-head driving mechanism according to some embodiments of the present disclosure.

FIG. 13 illustrates another cleaning-head driving mechanism 013 based on a double crank mechanism according to embodiments of the present disclosure. The driving mechanism 013 is applicable to the cleaning module 300. The driving mechanism 013 includes a driving wheel 334 (i.e., first driving wheel), a driving wheel 384 (i.e., second driving wheel), and a cleaning-head base board 382.

The cleaning-head base board 382 includes two ends. A first end is connected to the driving wheel 334 through a pivot 381 (i.e., first pivot), and a second end is connected to the driving wheel 384 through a pivot 383 (i.e., second pivot). A swing center of the driving wheel 334 is point O and a pivot center of the pivot 381 is point A. The point O and the point A do not coincide with each other, and a distance between the points O and A is a preset distance. A swing center of the driving wheel 384 is point O' and a pivot center of the pivot 383 is point A'. The point O' and point A' do not coincide with each other, and a distance between the point O' and point A' is also the preset distance. In some embodiments of the present disclosure, the points A, A', O' and O' are on a same plane. Accordingly, the driving wheel 334 the driving wheel 384, and the cleaning-head base board 382 cooperatively form a double crank mechanism (or a parallelogram mechanism), wherein the cleaning-head base board 382 serves as a coupling rod, and the driving wheels 334 and 384 serve as two cranks.

The engine 332 in FIG. 9 can drive both the driving wheel 334 and the driving wheel 384 simultaneously, so that both the driving wheels 334, 384 can serve as active driving wheels. Alternatively, the engine 332 may drive only one driving wheel (for example, the driving wheel 334), in such a case, the other driving wheel (e.g. the driving wheel 384) acts as a passive driving wheel. When the driving wheels 334 and/or the driving wheel 384 rotate, points A and A' conduct a circular motion. In some embodiments of the present disclosure, rotation speeds of the driving wheel 334 and the driving wheel 384 may be identical. The mobile platform 100 moves at a speed of V0 in the target direction. Therefore, the reciprocating movement of the base board 382 as a whole includes both a motion component perpendicular to the target direction and a motion component parallel to the target direction.

In addition to the above-mentioned driving-mechanisms that may be adapted to drive the cleaning-head 320 to conduct the reciprocating movement, other driving-mechanisms may be applied in the present disclosure, such as crank-rocker mechanism or double rocker mechanisms, etc. One of ordinary skill in the art would understand the implementations of other driving-mechanisms after reading the example implementations illustrated in FIGS. 10-13.

Figure 14:
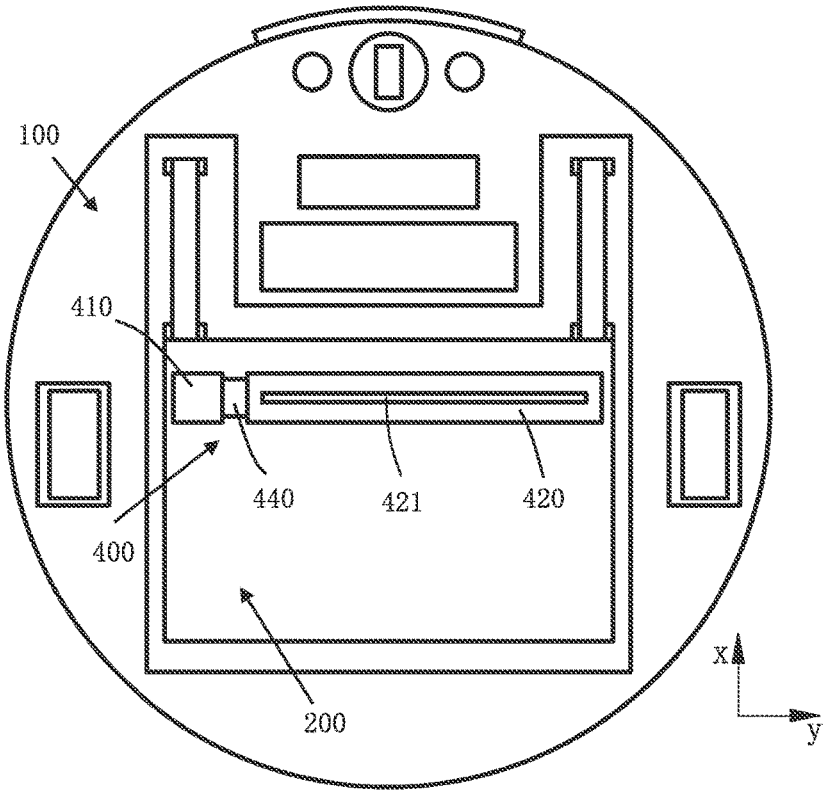
FIG. 14 is a schematic structural view of a liquid supplying module according to some embodiments of the present disclosure.

FIG. 14 illustrates a schematic structural view of a liquid supplying module 400 according to various embodiments of the present disclosure. FIG. 14 is a view obtained by observing from bottom. In some embodiments of the present disclosure, the liquid supplying module 400 includes a storage device 410, as illustrated in FIG. 14. The storage device 410 may be connected to the mobile platform 100 directly, or may be connected to the mobile platform 100 indirectly through the lifting station 200. The storage device 410 is configured to store cleaning liquid. The storage device 410 is provided with an opening (not shown in FIG. 14), and the cleaning liquid is delivered to the surface to be cleaned through the opening. The storage device 410 is detachably connected to the mobile platform 100. When the cleaning liquid in the storage device 410 runs out or is about to run out, the storage device 410 may be detached from the mobile platform 100 to be refilled with the cleaning liquid. The cleaning liquid flows to the surface to be cleaned through the opening of the storage device 410.

In some embodiments of the present disclosure, the liquid supplying module 400 may further include a dispenser 420, as illustrated in FIG. 14. The dispenser 420 is connected to the opening of the storage device 410 directly or indirectly, and the cleaning liquid flows to the dispenser 420 through the opening of the storage device 410, and then is evenly applied to the surface to be cleaned through the dispenser 420. The dispenser 420 is provided with a communicating port (not shown in FIG. 14), and the dispenser 420 is communicated to the opening of the storage device 410 through the communicating port. The dispenser 420 is further provided with a dispensing port 421. The dispensing port 421 may be a continuous opening or a combination of a plurality of discrete openings that are disconnected from each other. A plurality of nozzles (not shown in FIG. 14) may be provided at the dispensing port 421. The cleaning liquid flows to the dispensing port 421 through the opening of the storage device 410 and the communicating port of the distributor 420, and is evenly applied onto the surface to be cleaned through the dispensing port 421.

In some embodiments of the present disclosure, the liquid supplying module 400 may further include a liquid supply driving device 440, as illustrated in FIG. 14. The liquid supply driving device 440 may be mounted at the opening of the storage device 410.

The liquid supply driving device 440 is connected to the communicating port of the dispenser 420, and is configured to pump the cleaning liquid from the storage device 410 to the dispenser 420. The liquid supply driving device 440 may be a pump, for example, a gear pump, a blade pump, a plunger pump, and the like.

When the liquid supplying module 400 is in operation, the liquid supply driving device 440 may provide power to the liquid supplying module 400. Under the action of the liquid supply driving device 440, the cleaning liquid flows from the opening of the storage device 410 to the communicating port of the dispenser 420, and then to the dispensing port 421 of the dispenser 420, and finally is evenly applied onto the surface to be cleaned through the dispensing port 421. In some embodiments of the present disclosure, the storage device 410 and the liquid supply driving device 440 are arranged offset from a middle axial line of the mobile platform 100 extending along the back and forth direction of the mobile platform 100, for example, as shown in FIG. 14, the storage device 410 and the liquid supply driving device 440 are arranged on the left side of the middle axial line of the mobile platform 100 extending long the x-axis.

Figure 15A:
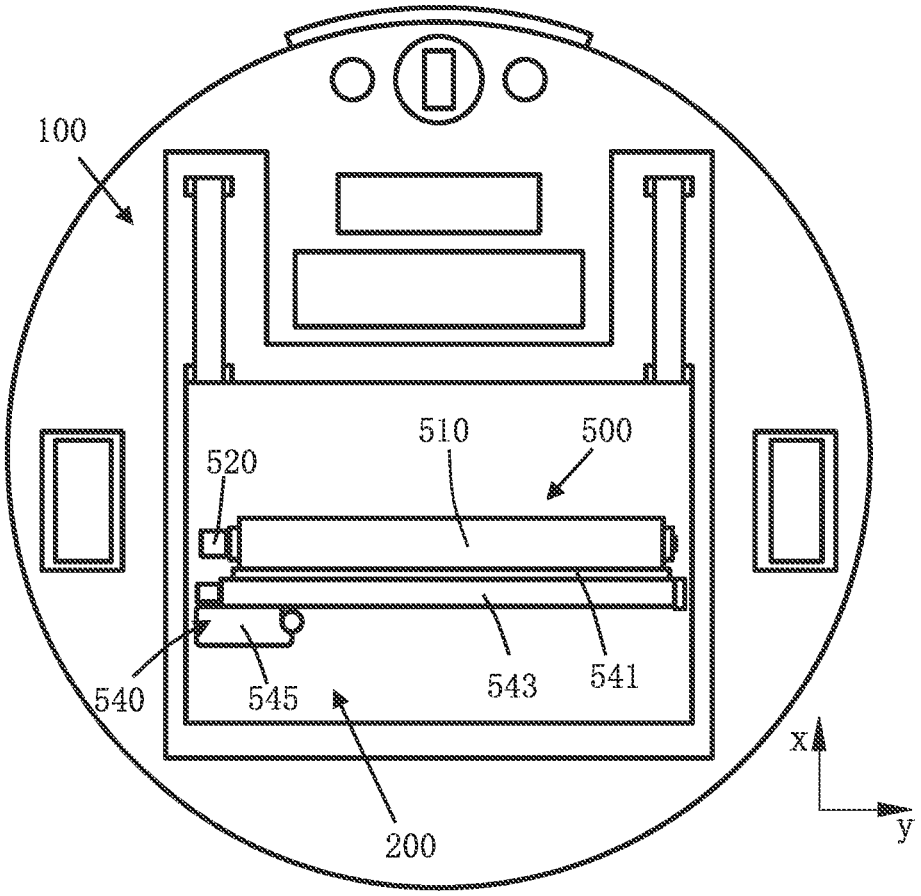
FIG. 15A is a schematic bottom view of a collecting module according to some embodiments of the present disclosure.
Figure 15B:
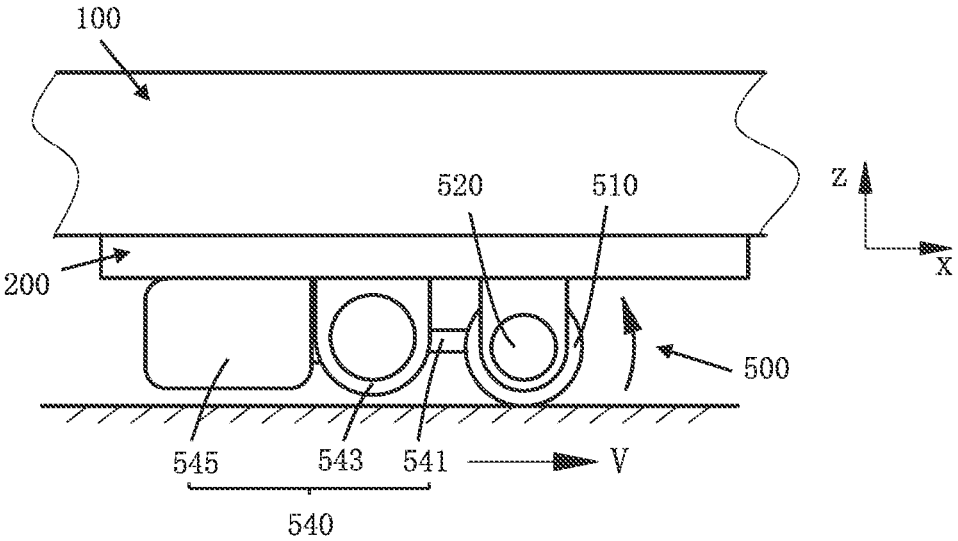
FIG. 15B illustrates a schematic side view of the collecting module in FIG. 15A.

FIG. 15A is a bottom schematic view of the collecting module 500 according to some embodiments of the present disclosure. FIG. 15B is a side view of the collecting module 500 illustrated in FIG. 15A. FIG. 15A is a view obtained by observing from bottom to top. FIG. 15B is a view obtained by observing from right to left. The collecting module 500 may include a roller 510. In some embodiments of the present disclosure, the collecting module 500 may further include a roller driving device 520, and a collecting assembly 540, as illustrated in FIGS. 15A and 15B.

Figure 16A:
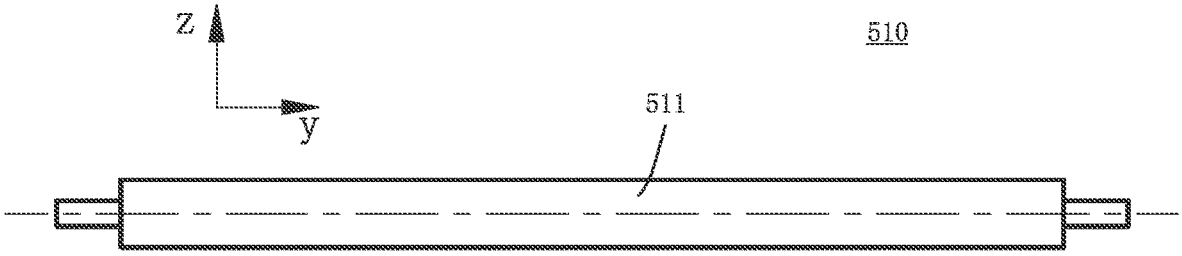
FIG. 16A illustrates a schematic structural view of a roller according to some embodiments of the present disclosure.
Figure 16B:
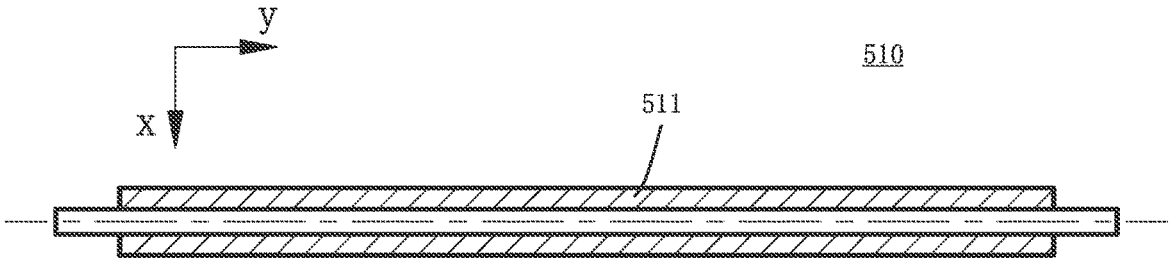
FIG. 16B illustrates a sectional view of the roller in FIG. 16A.

The roller 510 may be pivoted to the mobile platform 100, or may be pivoted to the mobile platform 100 indirectly through the lifting station 200. The roller 510 may rotate with respect to the mobile platform 100. In this case, when the collecting module 500 is in operation, the roller 510 may contact the surface to be cleaned. FIG. 16A illustrates a schematic structural view of a roller 510 according to some embodiments of the present disclosure. FIG. 16B illustrates a cross-sectional view of the roller 510 illustrated in FIG. 16A. As illustrated in FIGS. 16A and 16B, the roller 510 may include an elastic water-absorbing material 511 to absorb the cleaning liquid on the surface to be cleaned. As illustrated in FIG. 16B, an outer surface of the roller 510 is coated with a layer of elastic water-absorbing material 511 which can absorb the dirty cleaning liquid remaining on the surface to be cleaned. The elastic water-absorbing material 511 may be a water-absorbing fabric, a water-absorbing sponge, or the like.

The roller driving device 520 may be connected to the roller 510 directly, or may be connected to the roller 510 indirectly through a transmission mechanism (not shown in FIG. 15A). The roller driving device 520 may drive the roller 510 to rotate with respect to the mobile platform 100. When the collecting module 500 is in operation, the roller driving device 520 drives the roller 510 to rotate, and the elastic water-absorbing material 511 coated on the surface of the roller 510 may absorb dirty cleaning liquid on the surface to be cleaned. The roller driving device 520 may include a motor. The transmission mechanism may be a gear transmission mechanism, a chain transmission mechanism, a belt transmission mechanism, a worm gear transmission mechanism, or the like.

The collecting assembly 540 may be connected to the mobile platform 100 directly, or connected to the mobile platform 100 indirectly through the lifting station 200. The collecting assembly 540 is configured to collect the cleaning liquid absorbed by the roller 510. And the collecting assembly 540 includes a scraper 541 as illustrated in FIGS. 15A and 15B.

As illustrated in FIG. 15A, the scraper 541 is connected to the mobile platform 100 directly or indirectly. The scraper 541 is configured to press the roller 510 and squeeze out the cleaning liquid absorbed by the roller 510 by pressure. When the roller 510 rotates, the roller 510 passes by the scraper 541 in a direction from top to bottom. The roller driving device 520 may drive the roller 510 to move in a direction reverse to the target direction, or may drive the roller 510 to move in the target direction. In the case that the roller moves in the direction reverse to the target direction, a linear velocity V of a portion of the roller 510 in contact with the surface to be cleaned is in the target direction, wherein the target direction points to front of the mobile platform 100. In the case that the roller moves along the target direction, the linear velocity V of the portion of the roller 510 in contact with the surface to be cleaned is in a direction opposite to the target direction, wherein the direction opposite to the target direction points to the rear side of the mobile platform 100. As illustrated in FIG. 15B, when the collecting module 500 is in operation, the driving device 520 drives the roller 510 to move against the target direction; in such a case, the scraper 541 is located behind the roller 510, the roller 510 absorbs the dirty cleaning liquid on the surface to be cleaned; then the roller 510 passes by the scraper 541 from top to bottom, and the scraper 541 squeezes out the dirty cleaning liquid absorbed by the elastic water-absorbing material 511 by pressure. As described above, the driving device 520 may alternatively drive the roller 510 to move in the target direction; in this case, the scraper 541 may be located in front of the roller 510, the roller 510 absorbs the dirty cleaning liquid on the surface to be cleaned. And then, the roller 510 passes by the scraper 541 from top to bottom, so that scraper 541 squeezes out, by pressure, the dirty cleaning liquid absorbed by the elastic water-absorbing material 511.

As mentioned above, the collecting assembly 540 includes the scraper 541. In some embodiments of the present disclosure, the collecting assembly 540 may further include a sink 543 and a collecting bin 545, as illustrated in FIGS. 15A and 15B.

The sink 543 may be connected to the mobile platform 100 directly, or may be connected to the mobile platform indirectly through the lifting station 200. The sink 543 is configured to collect the cleaning liquid squeezed out from the roller 510 by the scraper 541. The sink 543 is connected to the scraper 541 and disposed on a side of scraper 541 away from roller 510. The scraper 541 is connected to the mobile platform 100 indirectly through the sink 543. Accordingly, as the scraper 541 squeezes the dirty cleaning liquid out from the roller 510, the dirty cleaning liquid flows into the sink 543.

The collecting bin 545 is communicated with the sink 543 directly or indirectly, and is configured to receive the dirty cleaning liquid from the sink 543, and the dirty cleaning liquid in the sink 543 may enter the collecting bin 545.

Figure 17A:
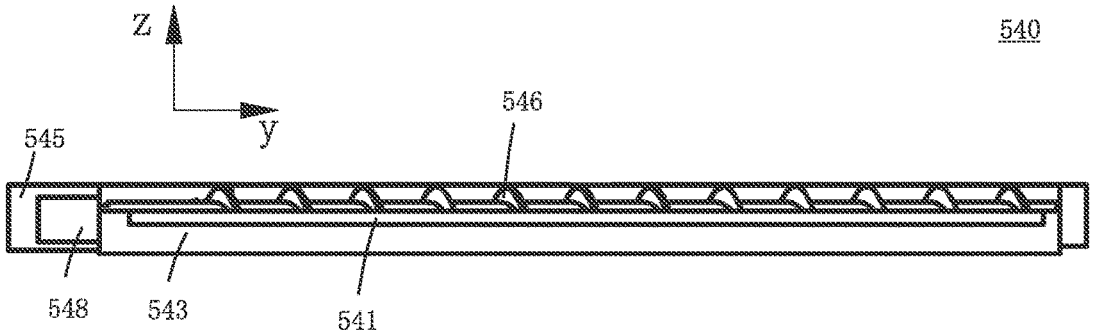
FIG. 17A illustrates a schematic structural view of a collecting assembly according to some embodiments of the present disclosure.
Figure 17B:
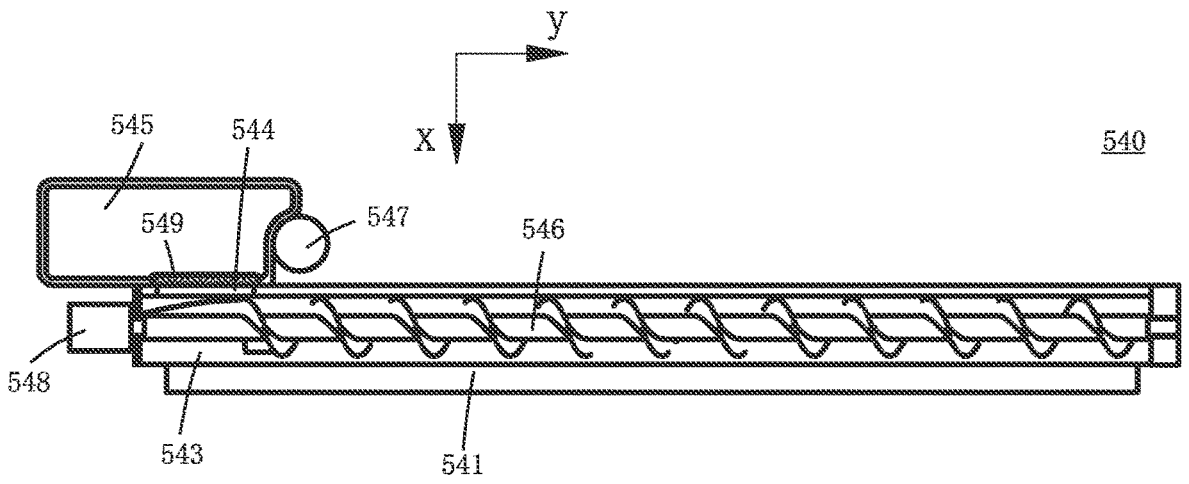
FIG. 17B illustrates a schematic top view of the collecting assembly in FIG. 17A.

FIG. 17A is a schematic structural view of the collecting assembly 540 according to some embodiments of the present disclosure, and FIG. 17A is a view obtained by observing from front to back. FIG. 17B is a schematic top view of a structure of the collecting assembly 540, obtained by observing from top to bottom. As illustrated in FIG. 17B, the sink 543 includes a collecting port 544, and the collecting bin 545 is communicated with the sink 543 through the collecting port 544; accordingly, the dirty cleaning liquid may enter the collecting bin 545 from the sink 543 through the collecting port 544.

In some embodiments of the present disclosure, the collecting assembly 540 may further include a blade 546. As illustrated in FIG. 17A and FIG. 17B, the blade 546 is pivotably disposed within the sink 543. The blade 546 may be pivoted to the mobile platform 100 through the sink 543, or may be pivoted to the mobile platform 100 through the lifting station 200 and the sink 543. The blade 546 may transport the dirty cleaning liquid from the sink 543 to the collecting port 544 through its rotation. The blade 546 may be a screw conveyor, a spiral blade brush, or the like, as illustrated in FIG. 17B.

In some embodiments of the present disclosure, the collecting assembly 540 further includes a collection driving device 547. As illustrated in FIG. 17B, the collection driving device 547 is connected to the collecting bin 545, and is configured to pump the dirty cleaning liquid from the collecting port 544 of the sink 543 into the collecting bin 545. The collection driving device 547 may be a pump, for example, a gear pump, a blade pump, a plunger pump, or the like. When the collecting assembly 540 is in operation, the collection driving device 547 supplies power to the collecting assembly 540. Under the action of the collection driving device 547, the dirty cleaning liquid flows to the collecting bin 545 from the collecting port 544 of the sink 543.

In some embodiments of the present disclosure, the collecting assembly 540 further includes a blade driving device 548. As illustrated in FIG. 17B, the blade driving device 548 is connected to the blade 546 directly or indirectly, and is configured to drive the blade 546 to rotate with respect to the mobile platform 100. The blade driving device 548 may be connected to the blade 546 directly, or may be connected to the blade 546 indirectly through a transmission mechanism (not shown in FIG. 17B). The blade driving device 548 may include a motor. The transmission mechanism may be a gear transmission mechanism, a chain transmission mechanism, a belt transmission mechanism, or a worm gear transmission mechanism, or the like.

When the collecting module 500 is in operation, the roller driving device 520 drives the roller 510 to rotate, and the roller 510 absorbs the dirty cleaning liquid on the surface to be cleaned; then the roller 510 passes by the scraper 541 from top to bottom, the scraper 541 squeezes out, by pressure, the dirty cleaning liquid absorbed by the elastic water-absorbing material 511, and the dirty cleaning liquid flows into the sink 543; the blade driving device 548 drives the blade 546 to rotate, thus the dirty cleaning liquid in the sink 543 is transported to an end of the sink 543 where the collecting port 544 is defined, through the rotation of the blade 546; and finally, the collection driving device 547 draws the dirty cleaning liquid at the collecting port 544 into the collecting bin 546.

In some embodiments of the present disclosure, the collecting assembly 540 further includes a filter 549. As illustrated in FIG. 17B, the filter 549 is disposed at the collecting port 544 and in communication with the collecting port 544. The filter 549 is configured to filter impurities from the dirty cleaning liquid. When the collection driving device 547 draws the dirty cleaning liquid at the collecting port 544, the dirty cleaning liquid is first filtered by the filter 549 which removes impurities from the dirty cleaning liquid and then flows into the collecting bin 545.

The liquid supply driving device 440, the roller driving device 520, the collection driving device 547 and the blade driving device 548 in the above embodiments may be powered by one motor, or may be powered by two, three, or four motors.

Figure 18:
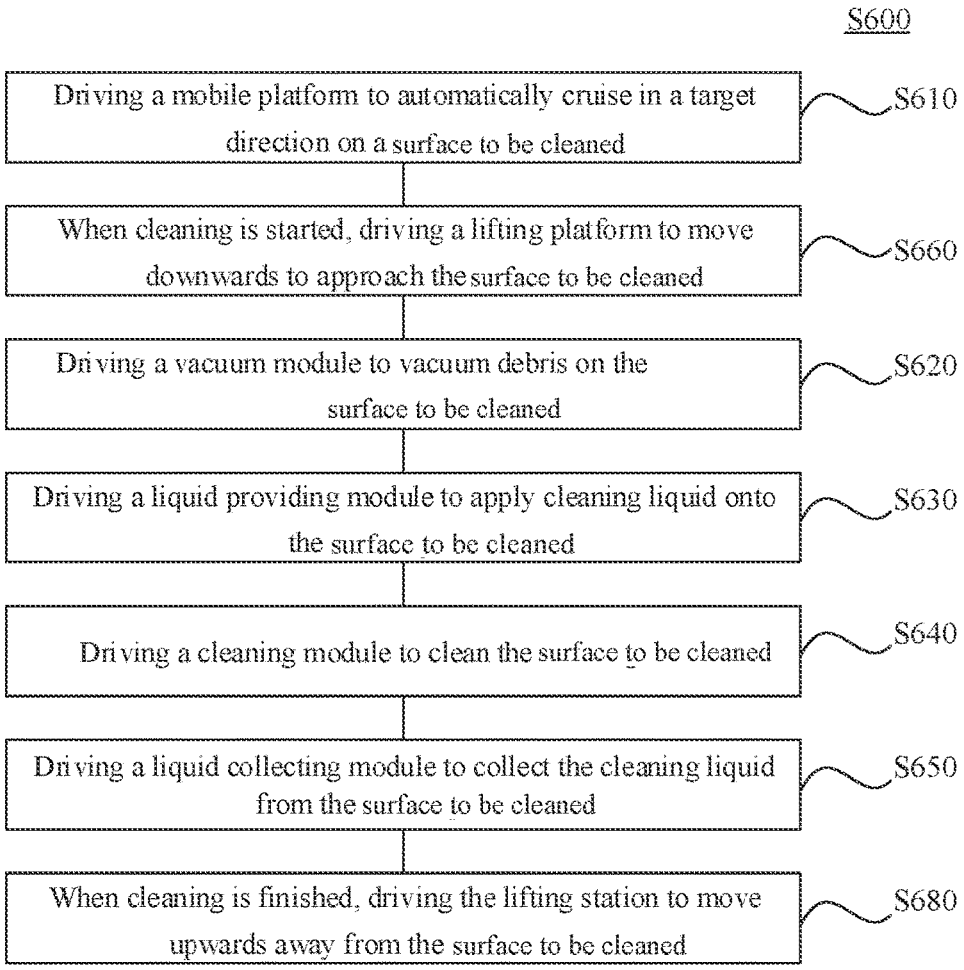
FIG. 18 illustrates a flowchart of a method of automatically cleaning a surface to be cleaned according to some embodiments of the present disclosure.

FIG. 18 illustrates a flowchart S600 of a method of automatically cleaning a surface to be cleaned according to some embodiments of the present disclosure. The method of automatically cleaning the surface to be cleaned includes:

S610: a mobile platform 100 is driven to automatically cruise in a target direction on a surface to be cleaned.

The target direction points to a front side of the mobile platform 100. The surface to be cleaned indicates a surface to be cleaned by the automatic cleaning device 001. Specifically, the power system 146 supplies power to a steering mechanism 144 and a wheel 142, thereby driving the mobile platform 100 to move on the surface to be cleaned. When the mobile platform 100 is an autonomous mobile platform, a cruising path may be determined by the autonomous cleaning device 001 on its own; when the mobile platform 100 is a non-autonomous mobile platform, the cruising path may be predetermined by the control system of the autonomous cleaning device 001 or manually predetermined by an operator (e.g., a user of the automatic cleaning device 001).

S660: when cleaning is started, the lifting station 200 is driven to move downwards to approach the surface to be cleaned.

Specifically, the automatic cleaning device 001 may further include a lifting station 200. The lifting station 200 is mounted on the mobile platform 100. A vacuum module 700, a liquid supplying module 400, a cleaning module 300 and a collecting module 500 may be connected to the mobile platform 100 directly, or may be connected to the mobile platform 100 through the lifting station 200. When cleaning is started, the lifting station 200 brings the modules mounted on the lifting station 200 to move downwards together and approach the surface to be cleaned in order to clean the surface to be cleaned.

S620: a vacuum module 700 is driven to vacuum debris away from the surface to be cleaned.

Specifically, a vacuum driving device suctions dirt and debris from the surface to be cleaned into the dust box by generating a vacuum flow. The vacuum module 700 may further include a roller brush, which is configured to move dirt and debris into the vacuum module 700 through a rotary motion thereof in cooperation with the vacuum flow.

S630: the liquid supplying module 400 is driven to supply a cleaning liquid onto the surface to be cleaned.

Specifically, a liquid supply driving device 440 may supply power to the liquid supplying module 400. Under the action of the liquid supply driving device 440, cleaning liquid flows from an opening of a storage device 410 to a communicating port of a dispenser 420; and finally the cleaning liquid flows to a dispensing port 421 of the dispenser 420 and is evenly distributed onto the surface to be cleaned through the dispensing port 421.

S640: the cleaning module 300 is driven to clean the surface to be cleaned.

The automatic cleaning device 001 drives the cleaning-head 320 to conduct a reciprocating movement on the surface to be cleaned, wherein the cleaning-head 320 is mounted on the mobile platform or on the lifting station 200.

In some embodiments of the present disclosure, the reciprocating movement includes a motion component perpendicular to the target direction X, or a motion component parallel to the target direction X, or a combination thereof.

In some embodiments of the present disclosure, the reciprocating movement includes a circular swing motion.

In some embodiments of the present disclosure, driving the cleaning-head to conduct the reciprocating movement on the surface to be cleaned includes driving, by a slider-crank mechanism, the cleaning-head to conduct the reciprocating movement. The description related to FIGS. 10-12 may be referred for details of the slider-crank mechanism.

In some embodiments of the present disclosure, driving the cleaning-head to conduct the reciprocating movement on the surface to be cleaned includes driving, by a double crank mechanism, the cleaning-head to conduct the reciprocating movement. The description related to in FIG. 13 may be referred for details of the double crank mechanism.

In some embodiments of the present disclosure, the automatic cleaning device 001 may dynamically adjust a position of the cleaning-head 320 according to a contour of the surface to be cleaned, so that the cleaning-head is kept in tight contact with the surface to be cleaned. For example, in the automatic cleaning device 001, the cleaning-head 320 is mounted on the lifting station 200, and the position of the cleaning-head 320 (i.e., a distance from the cleaning-head 320 to the surface to be cleaned) is dynamically adjusted by the lifting station 200, so that the cleaning-head 320 (e.g., a working-head 324) is kept in tight contact with the surface to be cleaned, thereby enhancing the cleaning capability of the automatic cleaning device 001.

S650: a collecting module 500 is driven to collect cleaning liquid on the surface to be cleaned, wherein the vacuum module 700, the liquid supplying module 400, the cleaning module 300, and the collecting module 500 are mounted on the mobile platform 100.

Specifically, when the collecting module 500 is in operation, a roller driving device 520 drives a roller 510 to rotate, the roller 510 absorbs the dirty cleaning liquid on the surface to be cleaned; then the roller 510 passes by the scraper 541 from top to bottom, the scraper 541 squeezes, by a pressure, the dirty cleaning liquid absorbed by elastic water-absorbing material 511 out from the elastic water-absorbing material 511, and the dirty cleaning liquid flows into a sink 543; a blade driving device 548 drives a blade 546 to rotate, and thus to transport the dirty cleaning liquid within the sink 543 to a region of the sink 543 close to a collecting port 544 through rotation of the blade 546; and finally, a collection driving device 547 draws the dirty cleaning liquid close to the collecting port 544 into a collecting bin 546.

The vacuum module 700, the liquid supplying module 400, the cleaning module 300 and the collecting module 500 may be mounted on the mobile platform 100 directly or indirectly.

S680: when the cleaning is finished, the lifting station 200 is driven to move upwards away from the surface to be cleaned.

Specifically, when the cleaning is finished, the lifting station 200 brings the modules mounted thereon to move upwards away from the surface to be cleaned, and the mobile platform 100 may move on the surface to be cleaned.

In some embodiments of the present disclosure, the cleaning module 300 is mounted on the mobile platform 100 through the lifting station 200, and the vacuum module 700 is mounted on the mobile platform 100 directly. Alternatively, the cleaning module 300 is mounted on the mobile platform 100 directly, and the vacuum module 700 is mounted on the mobile platform 100 through the lifting station 200. Certainly, the cleaning module 300 and the vacuum module 700 may be both mounted on the mobile platform 100 through the lifting station 200. In the case that the cleaning module 300 is mounted on the lifting station 200 and the vacuum module 700 is mounted on the mobile platform 100 directly, when cleaning is started, the cleaning module 300 moves downwards along with the lifting station 200 to approach the surface to be cleaned so as to clean the surface to be cleaned; when the cleaning is finished, the cleaning module 300 moves upwards along with the lifting station 200 away from the surface to be cleaned. In the case that the cleaning module 300 is mounted on the mobile platform 100 directly and the vacuum module 700 is mounted on the lifting station 200, when cleaning is started, the vacuum module 700 moves downwards along with the lifting station 200 to approach the surface to be cleaned so as to vacuum the surface to be cleaned; when cleaning is finished, the vacuum module 700 moves upwards along with the lifting station 200 away from the surface to be cleaned. In the case that both the cleaning module 300 and the vacuum module 700 are mounted on the lifting station 200, when cleaning is started, the cleaning module 300 and the vacuum module 700 move downwards along with the lifting station 200 to approach the surface to be cleaned so as to clean the surface to be cleaned; when cleaning is finished, the cleaning module 300 and the vacuum module 700 move upwards along with the lifting station 200 away from the surface to be cleaned.

In view of the foregoing, it will be understood by one of ordinary skill in the art that the contents detailed in the disclosure are provided by means of examples, and cannot be construed as a limit to the present disclosure. Although not explicitly stated herein, it should be noted by one of ordinary skill in the art that, the present disclosure covers various changes, improvements and modifications of the embodiments. These changes, improvements, and modifications are intended to be proposed by the present disclosure and fall within the spirit and scope of the exemplary embodiments of the present disclosure.

In addition, some of the terms used in this disclosure are intended to describe embodiments of the present disclosure. For example, "one embodiment", "an embodiment" and/or "some embodiments" means that a particular feature, structure or characteristic described in connection with the embodiment may be included in at least one embodiment of the present disclosure. Therefore, it should be emphasized and understood that in various parts of the present disclosure, the terms "an embodiment" or "one embodiment" or "an alternative embodiment" are not necessarily referring to a same embodiment. Furthermore, the particular features, structures, or characteristics may be combined in an appropriate manner in one or more embodiments of the present disclosure.

It should be understood that in the description of the embodiments of the present disclosure, to assist in understanding a feature and for the purpose of simplifying the description of the present disclosure, sometimes various features may be combined in a single embodiment, or drawings, description thereof. Alternatively, various features may be described in different embodiments of the present disclosure. However, this is not to say that a combination of these features is necessary, and it is possible for one of ordinary skill in the art to understand that a part of these features may be taken as a separate embodiment. That is to say, the embodiments of the present disclosure may also be understood as an integration of a plurality of secondary embodiments. It is also true that content of each of the sub-embodiments is less than all the features of a single embodiment as described above.

In some embodiments of the present disclosure, numbers indicating quantities or properties intended to describe or define the embodiments of the present disclosure should be understood as being modified by the terms "about," "approximate," or "substantially" in some instances. For example, "about," "approximately" or "substantially" may mean±20% change in the described value unless stated otherwise. Accordingly, in some embodiments of the present disclosure, the numerical parameters set forth in the written description and the appended claims are approximations, which may vary depending upon desired properties sought in a particular embodiment. In some embodiments of the present disclosure, numerical parameters should be interpreted in accordance with the value of the parameters and by applying ordinary rounding techniques. Although some embodiments of the present application provide numerical ranges and parameters that are in a broad range and are approximate, the values in the specific examples are provide as accurate as possible.

Each of the patents, the patent applications, the patent application publications, and other materials, such as articles, books, manuals, publications, documents, products, etc., cited herein are hereby incorporated by reference for all purposes, except for any history of prosecution documents associated therewith, any identical, or any identical prosecution document history, which may be inconsistent or conflicting with this document, or any such subject matter that may have a restrictive effect on the broadest scope of the claims associated with this document now or later. For example, if there is any inconsistence or conflicting in descriptions, definitions, and/or use of a term associated with this document with descriptions, definitions, and/or use of the term associated with any materials in the present disclosure, the terms in this document shall govern.

Finally, it should be understood that the embodiments of the disclosure disclosed herein are merely described to illustrate the principles of the embodiments of the disclosure. Other modified embodiments are also within the scope of this disclosure. Therefore, the embodiments disclosed herein are by way of example only and cannot be construed as a limit to the present disclosure. One of ordinary skill in the art may adopt alternative configurations to implement the invention in this disclosure in accordance with the embodiments of the present disclosure. Therefore, the embodiments of the present disclosure are not limited to those embodiments that have been precisely described in this disclosure.

The invention claimed is:

1. An automatic cleaning device, comprising:

a mobile platform configured to automatically move in a target direction on a surface to be cleaned, the mobile platform having a bottom surface;

a wet-mode cleaning module comprising a cleaning-head, a distance between the cleaning-head and the bottom surface of the mobile platform being adjustable; and a lifting mechanism configured to drive, via a linear driving mechanism, the cleaning-head to move to thereby adjust the distance between the cleaning-head and the bottom surface of the mobile platform;

wherein when the linear driving mechanism moves in a direction, the distance between the cleaning-head and the bottom surface of the mobile platform is increased; and when the linear driving mechanism moves in another direction reverse to said direction, the distance between the cleaning-head and the bottom surface of the mobile platform is decreased;

wherein an elastic support structure is arranged between the lifting mechanism and the cleaning-head and configured to urge the cleaning-head to abut against the surface to be cleaned;

wherein the cleaning-head is configured to move relative to the lifting mechanism under a driving force from a gear set to thereby clean the surface to be cleaned; and wherein a power source, from which the driving force comes, comprises an output shaft, and a line passing through an axis of the output shaft is distant from a region surrounded by a boundary of the cleaning-head.

2. The automatic cleaning device according to claim 1, wherein the linear driving mechanism comprises an electric push rod, a lead screw nut, or a cylinder.

3. The automatic cleaning device according to claim 1, wherein the cleaning-head has a plate-like structure.

4. The automatic cleaning device according to claim 3, wherein the plate-like structure has a square shape, round shape or irregular shape.

5. The automatic cleaning device according to claim 1, wherein the automatic cleaning device comprises a lifting base;

when the linear driving mechanism moves in said direction, the distance between the lifting base and the mobile platform is increased; and when the linear driving mechanism moves in said another direction, the distance between the lifting base and the mobile platform is decreased.

6. The automatic cleaning device according to claim 5, wherein the cleaning-head comprises a working head configured to clean the surface to be cleaned.

7. The automatic cleaning device according to claim 6, wherein the working head comprises at least one of a brush, a rag, and a sponge.

8. The automatic cleaning device according to claim 1, wherein the cleaning-head is capable of moving relative to the lifting mechanism in a direction parallel to the surface to be cleaned under the driving force from the gear set.

9. The automatic cleaning device according to claim 1, wherein the cleaning-head comprises a cleaning-head base board and a working-head which has a shape conformed to a shape of the cleaning-head base board.

10. The automatic cleaning device according to claim 9, wherein the elastic support structure is arranged between the cleaning-head base board and the linear driving mechanism.

11. The automatic cleaning device according to claim 1, further comprising a liquid supplying module configured to supply a cleaning liquid to the surface to be cleaned.

12. The automatic cleaning device according to claim 11, wherein the liquid supplying module comprises a storage device configured to store the cleaning liquid, the storage device being arranged offset from a middle axial line of the mobile platform extending along a back and forth direction of the mobile platform.

13. The automatic cleaning device according to claim 12, wherein the liquid supplying module further comprises a liquid supply driving device configured to drive the cleaning liquid to flow out from the storage device, the liquid supply driving device being arranged offset from the middle axial line of the mobile platform extending along the back and forth direction of the mobile platform.

14. The automatic cleaning device according to claim 13, wherein the liquid supplying module further comprises a dispenser, the liquid supply driving device being arranged between the storage device and the dispenser and configured to drive the cleaning liquid to flow from the opening of the storage device to the dispenser and then flow out of the dispenser.

15. The automatic cleaning device according to claim 14, wherein the dispenser comprises a dispensing port which is a continuous opening or a combination of a plurality of discrete openings or nozzles that are disconnected from each other.

16. The automatic cleaning device according to claim 11, further comprising a vacuum module which is arranged in front of the liquid supplying module.

17. The automatic cleaning device according to claim 16, wherein an area of the vacuum module projected in the bottom surface of the mobile platform is less than that of the wet-mode cleaning module.

18. An automatic cleaning device, comprising:

a mobile platform configured to automatically move in a target direction on a surface to be cleaned, the mobile platform having a bottom surface;

a wet-mode cleaning module comprising a cleaning-head, a distance between the cleaning-head and the bottom surface of the mobile platform being adjustable;

a lifting mechanism configured to drive, via two linear driving mechanisms, the cleaning-head to move to thereby adjust the distance between the cleaning-head and the bottom surface of the mobile platform;

wherein each of the linear driving mechanisms comprises a lead screw nut;

when the linear driving mechanisms move in a direction, the distance between the cleaning-head and the bottom surface of the mobile platform is increased;

when the linear driving mechanisms move in another direction reverse to said direction, the distance between the cleaning-head and the bottom surface of the mobile platform is decreased;

wherein the automatic cleaning device further comprises a liquid supplying module configured to supply a cleaning liquid to the surface to be cleaned; and wherein the liquid supplying module comprises a storage device configured to store the cleaning liquid, the storage device being arranged with a middle line thereof offset from a middle axial line of the mobile platform extending along a back and forth direction of the mobile platform.

19. An automatic cleaning device, comprising:

a mobile platform configured to automatically move in a target direction on a surface to be cleaned, the mobile platform having a bottom surface;

a wet-mode cleaning module comprising at least one cleaning-head, a distance between the cleaning-head and the bottom surface of the mobile platform being adjustable;

a lifting mechanism configured to drive, via a linear driving mechanism, the at least one cleaning-head to move to thereby adjust the distance between the cleaning-head and the bottom surface of the mobile platform;

wherein when the linear driving mechanism moves in a direction, the distance between the cleaning-head and the bottom surface of the mobile platform is increased;

when the linear driving mechanism moves in another direction reverse to said direction, the distance between the cleaning-head and the bottom surface of the mobile platform is decreased;

wherein the automatic cleaning device comprises two said linear driving mechanisms respectively arranged at left and right sides thereof and configured to drive the at least one cleaning-head to move up and down;

wherein each of the linear driving mechanisms comprises a lead screw nut;

wherein the automatic cleaning device further comprises a liquid supplying module configured to supply a cleaning liquid to the surface to be cleaned, and a vacuum module which is arranged in front of the liquid supplying module, and wherein the cleaning-head is configured to move relative to the lifting mechanism under a driving force from a power source to thereby clean the surface to be cleaned.

* * * * *